US005210584A

United States Patent [19]

Ogino et al.

[11] Patent Number: 5,210,584

[45] Date of Patent: May 11, 1993

[54] MULTI-COLORED IMAGE FORMING APPARATUS HAVING A MOVABLE SUPPORT MEMBER FOR THE DEVELOPING DEVICE

[75] Inventors: Shigeo Ogino; Kazuaki Shiotsuka, both of Toyokawa, Japan

[73] Assignee: Minolta Camera Kabushiki Kaisha, Osaka, Japan

[21] Appl. No.: 625,062

[22] Filed: Dec. 10, 1990

[30] Foreign Application Priority Data

| | | | |
|---|---|---|---|
| Dec. 12, 1989 | [JP] | Japan | 1-321837 |
| Dec. 12, 1989 | [JP] | Japan | 1-321838 |
| Dec. 12, 1989 | [JP] | Japan | 1-321839 |
| Dec. 12, 1989 | [JP] | Japan | 1-321840 |
| Dec. 12, 1989 | [JP] | Japan | 1-321841 |

[51] Int. Cl.[5] ..... G03G 15/01; G03G 15/08

[52] U.S. Cl. ..... 355/327; 355/245

[58] Field of Search ..... 355/326, 327, 245, 206, 355/205

[56] References Cited

U.S. PATENT DOCUMENTS

| | | | |
|---|---|---|---|
| 4,615,612 | 10/1986 | Ohno et al. . | |
| 4,841,329 | 6/1989 | Kasamura et al. | 355/245 |
| 4,841,336 | 6/1989 | Kusumoto et al. | 355/245 |
| 4,885,611 | 12/1989 | Higashio et al. | 355/245 |
| 4,891,672 | 1/1990 | Takagi | 355/245 |
| 4,894,684 | 1/1990 | Nakajima et al. | 355/326 X |
| 4,928,146 | 5/1990 | Yamada | 355/326 X |
| 4,937,624 | 6/1990 | Kohtani et al. | 355/245 |
| 4,937,626 | 6/1990 | Kohtani et al. | 355/245 |
| 4,939,548 | 7/1990 | Yamada et al. | 355/245 |
| 4,941,018 | 7/1990 | Kasamura et al. | 355/245 |
| 4,952,987 | 8/1990 | Takamo | 355/206 X |
| 4,958,191 | 9/1990 | Yamada et al. | 355/245 |
| 4,963,935 | 10/1990 | Kawabuchi | 355/245 |

FOREIGN PATENT DOCUMENTS

| | | |
|---|---|---|
| 57-204567 | 12/1982 | Japan . |
| 61-151564 | 7/1986 | Japan . |

*Primary Examiner*—Richard L. Moses

*Attorney, Agent, or Firm*—Burns, Doane, Swecker & Mathis

[57] ABSTRACT

An image forming apparatus including a movable type developing unit carrying a plurality of developing devices for performing a developing function using a plurality of color toners. The developing unit is vertically moved along a photosensitive drum. It is detected by a sensor whether or not a selected developing device is at a first position of the level of the developing position. In carrying out a developing operation, the developing device at the first position is moved to a second position adjacent to a photosensitive drum. The following problems are detected based on the ON and OFF state of the sensor: if the developing device does not move to the second position a predetermined period of time after an instruction for moving it from the first position to the second position is issued or if the developing device does not move to the first position a predetermined period of time after an instruction for returning it from the second position to the first position is issued. Based on the detection of the above problems, the developing unit is prohibited from vertically moving and copy paper is discharged from the apparatus.

18 Claims, 25 Drawing Sheets

MULTI-COLORED IMAGE FORMING APPARATUS HAVING A MOVABLE SUPPORT MEMBER FOR THE DEVELOPING DEVICE

BACKGROUND OF THE INVENTION

1. Field of the invention

The present invention relates to an image forming apparatus, having a moving type developing unit carrying a plurality of developing devices, for developing an electrostatic latent image formed on a photosensitive drum by a selected developing device at a predetermined position.

2. Description of the Related Art

According to a image forming apparatus, in which a developing unit is moved, disclosed in Japanese Patent Laid-Open Publication No. 57-204567, a developing unit which moves vertically carries a plurality of developing devices. In the above apparatus, a selected developing device accommodating a color toner is stopped at a position, for performing a developing operation, opposed to a photosensitive drum. The developing device is moved between a position adjacent to a photosensitive drum at which the developing sleeve is opposed to the photosensitive drum with a predetermined distance spaced therebetween and a position, spaced a predetermined distance from the movement of the developing unit.

In this apparatus, if the developing device is not positioned with the predetermined position away from the photosensitive drum in moving the developing device toward the photosensitive drum, i.e., if the distance between the developing sleeve and the photosensitive drum is not appropriate, a normal developing operation cannot be accomplished. As a result, the following disadvantages occur: the density of a developed image is light; copy paper having no electrostatic latent image developed is discharged from the apparatus; or an image having a desired color is not developed. It is necessary to move the developing device from the position adjacent to the photosensitive drum to the position spaced from the photosensitive drum after a developing operation is completed. If at this time, the developing device is not returned to the position for allowing the movement of the developing unit due to an abnormality of a mechanism for moving the developing device, the developing device prevents the developing unit from moving vertically. An operation for forcibly moving the developing unit damages the developing device, the photosensitive drum, or members positioned in the vicinity thereof.

However, none of the conventional image forming apparatuses have countermeasures for overcoming the above disadvantage.

In order to securely stop a selected developing device at the developing position in an image forming apparatus in which the developing unit is moved, it is necessary to brake a motor for driving the developing unit at an appropriate timing. According to an apparatus in which the developing unit is locked by a locking mechanism at a desired position, it is necessary to lock the developing unit at the developing position after a selected developing unit is reliably stopped there so that a lock-caused shock does not affect a developing operation.

Various systems having such a function as described above have been proposed, for example, in U.S. Pat. No. 4,615,612 which discloses an image forming apparatus having a developing unit having a plurality of developing devices arranged in a rotary member. In this apparatus, a selected developing device is driven to the developing position to perform a development. The feature of this apparatus is that the moving speed of the developing device and/or the position of the developing device is detected. A detected value (values) is compared with a target value. The output of a motor for driving the developing unit is controlled in such a manner that the difference between the detected value and the target value is compensated. An image forming apparatus disclosed in Japanese Patent Laid-Open Publication No. 61-151564 is similar to the art of U.S. Pat. No. 4,615,612. According to the disclosure, the distance moved by the developing unit with respect to the reference position is counted by a counter. If a counted value coincides with a value predetermined according to a target value, a signal for locking the developing unit at the developing position is generated so that a locking means stops a selected developing device at the developing position. In order to permit a developing operation, the following condition must also be satisfied: A sensor detects a selected developing device at the developing position a predetermined period of time in relation to the time at which the developing device has started moving.

According to the above prior arts, the drive and stop of the developing unit and the timing for locking the developing unit are not controlled by directly detecting the current position of the developing unit, but by data obtained by calculating the current position of the developing unit based on the number of rotations of the driving motor. According to the above-described control method, if the number of rotations of the driving motor is erroneously detected or an erroneous calculation is performed, a brake cannot be applied at an appropriate timing to means for driving the developing unit. As such, the developing unit cannot be stopped at a desired position. If the number of rotations of the driving motor is erroneously detected or an erroneous calculation is performed, the developing unit cannot be locked at an appropriate timing. As a result, improper force is applied to the mechanism for locking the developing unit. As such, the locking mechanism is damaged or the developing device cannot be stopped at the predetermined position with respect to the photosensitive drum. Further, it is necessary to provide the apparatus with a detecting device such as a pulse producing disk for detecting the number of rotations of the driving motor. Thus, the apparatus is incapable of avoiding a complicated structure.

SUMMARY OF THE INVENTION

Accordingly, it is an essential object of the present invention to provide an image forming apparatus in which it is possible to reliably detect the movement of a selected developing device in the developing position between one predetermined position adjacent to an image holding member and the other predetermined position away from the image holding member.

It is another object of the present invention to provide an image forming apparatus in which it is possible to fix a movable supporting member carrying a plurality of developing devices to a predetermined position at an appropriate timing and confirm that the movable supporting member has been locked at a proper position.

It is still another object of the present invention to provide an image forming apparatus in which it is possible, by a simple construction, to precisely stop a movable supporting member carrying a plurality of developing devices at a predetermined position.

It is a further object of the present invention to provide an image forming apparatus in which it is possible to control the movement of a movable supporting member carrying a plurality of developing devices so as to reliably stop a selected developing device at the developing position.

It is a still further object of the present invention to provide an image forming apparatus in which it is possible to move a selected developing device to the developing position in a constant period of time irrespective of the distance moved by the developing device.

According to one preferred embodiment of the present invention, there is provided an image forming apparatus having a plurality of developing devices, mounted on a movable supporting member, for performing a multi-color development comprising: driving means for driving the movable supporting member in a predetermined direction; developing device detecting means for detecting a developing device at the developing position in which a developing operation is performed; developing device moving means for moving the developing device at a developing position between a first position, adjacent to the image holding member, in which a developing operation can be carried out and a second position a certain distance away from the image holding member; and control means for prohibiting the movement of the movable supporting member if the developing device is not detected by the developing device detecting means a predetermined period of time after the developing device moving means starts the operation for moving the developing device away from the first position toward the second position.

According to the above construction, if it is detected by the developing device detecting means that the operation for moving the developing device away from the image holding member is abnormal, the developing device detecting means does not operate. That is, the developing device detecting means remains OFF. Based on this condition, the occurrence of a trouble is detected, the movement of the movable supporting member is prohibited, and copy paper is discharged from the apparatus.

Further, it is preferable that the above control means moves the movable supporting member to the reference position of the movement of the movable supporting member if the developing device remains detected by the developing device detecting means a predetermined period of time after the developing device moving means starts the operation for moving the developing device toward the image holding member. If abnormality is detected in the operation for moving the developing device toward the photosensitive drum to be performed before a copying operation is carried out, the developing device detecting means remains operable, namely, ON. In this condition, if the occurrence of a trouble or problem is detected, the movement of the movable supporting member is prohibited, and copy paper is discharged from the apparatus.

According to another preferred embodiment of the present invention, there is provided an image forming apparatus having a plurality of developing devices, mounted on a movable supporting member, for performing a multi-color development comprising: driving means for driving the movable supporting member in a predetermined direction and stopping the member so that a selected developing device is located at the developing position in which a developing operation is performed; developing device detecting means for detecting the developing device at the developing position; fixing means for fixing the movable supporting member at a predetermined position; and control means for operating the fixing means when the selected developing device is detected by the developing device detecting means.

According to the above construction, when the movable supporting member starts moving and the developing device reaches the developing position, the developing device is detected by the developing device detecting means.

A signal is outputted from the developing device detecting means to the control means. In response to the signal, the control means operates the fixing means. As a result, the movable supporting means is locked. That is, the timing for locking the movable supporting member is controlled by the signal outputted from the developing device detecting means which directly detects the movable supporting means.

This mechanism eliminates the provision of a sensor such as a pulse producing disk for detecting the number of rotations of the driving motor. Further, unlike the conventional art, the movable supporting means can be locked at an appropriate timing. Thus, the developing device can be appropriately locked at the developing position by a simple construction.

It is preferable to provide the fixed state detecting means for detecting the movable supporting member when it is fixed by the fixing means. When it is detected by the fixed state detecting means that the movable supporting member has been fixed to the predetermined position before a selected developing device is detected by the developing device detecting means, the following operations are performed: the stop of the driving motor, the prohibition of a copy operation, and the discharge of copy paper. In this manner, an overload on the driving motor and it does not occur that the image of an original document is copied in an undesired color. A developing operation can be performed by signals outputted from the developing device detecting means and the fixed state detecting means fixed to the main body. That is, this construction does not require a complicated control using a timer. Therefore, the occurrence of errors can be greatly reduced.

According to still another preferred embodiment of the present invention, there is provided an image forming apparatus having a plurality of developing devices, mounted on a movable supporting member, for performing a multi-color development comprising: driving means for driving the movable supporting member in a predetermined direction and stopping the movable supporting member so that a selected developing device is located at the developing position in which a developing operation is performed; developing device detecting means for detecting the passage of developing devices through the developing position; counting means for counting the number of developing devices which have passed the developing position based on a signal outputted from the developing device detecting means; calculating means for calculating the number of developing devices which are to pass the developing position before the selected developing device reaches the developing position; and control means for outputting a stop signal to the driving means when the number of developing devices counted by the counting means coincides with the number calculated by the calculating means.

According to the above construction, based on the relationship between a current position of the movable supporting member and a selected developing device, the calculating means calculates the number of developing devices which are to pass the developing position from the time when the selected developing device starts moving until the time when it stops at the developing position. The number of developing devices which are to pass the developing position corresponds to the distance of the movement of the developing unit. Upon start of the movable supporting member, the developing devices which pass the developing position are detected and the number of the developing devices is counted. The number of the developing devices is compared with the value calculated by the calculating means. When both numbers coincide with each other, a brake signal is outputted from the drive control means to the driving means.

As described above, the timing for braking the movable supporting member is controlled by directly detecting the position of the movable supporting member. Therefore, the occurrence of errors can be greatly reduced. Further, it is unnecessary to provide the apparatus with a sensor for detecting the number of rotations of the driving motor.

According to still another preferred embodiment of the present invention, there is provided an image forming apparatus having a plurality of developing devices, mounted on a movable supporting member, for performing a multi-color development comprising: driving means for driving the movable supporting member in a predetermined direction and stopping a selected developing device at the developing position in which a developing operation is performed; drive control means for outputting a stop signal to the driving means at a predetermined timing so as to stop the movable supporting member so that a selected developing device at the developing position; developing device detecting means for detecting the developing device at the developing position; fixing means for fixing the movable supporting member when the selected developing device has reached the developing position; and control means for prohibiting an operation of the fixing means if the selected developing device at the developing position is detected before the stop signal is outputted.

According to the above construction, in a normal condition, the drive control means outputs a brake signal at a timing so as to stop a selected developing device at the developing position. In response to the brake signal, the driving means applies a brake to the movable supporting member. When the selected developing device stops at the developing position, the fixing means operates. As a result, the movable supporting member is locked.

If the selected developing device arrives at the developing position due to an abnormality before the brake signal is outputted, a processing for the trouble is executed. That is, the developing unit is securely prohibited from being locked when the developing unit is not operated.

The processing for the trouble is reliably executed because the selected developing device at the developing position is directly detected by the developing device detecting means. Thus, the movable supporting member is prohibited from being locked when the developing unit is not operated. Therefore, there is no damage to the locking mechanism, members in the periphery thereof, and the photosensitive drum.

According to still another preferred embodiment of the present invention, there is provided an image forming apparatus having a plurality of developing devices, mounted on a movable supporting member, for performing a development by moving a desired developing device to a developing position comprising: driving means for driving the movable supporting member in a predetermined direction and stopping the member so that a desired developing device is located at the developing position; speed control means for controlling a driving speed of the driving means; calculating means for calculating the number of developing devices which are to pass the developing position before the desired developing device reaches the developing position; and control means for outputting a speed change signal to the speed control means so as to change the speed of the movable supporting member according to a result obtained by the calculating means in such a manner that the speed of the movable supporting member is increased with the increase of the number of developing devices which are to pass the developing position.

According to the above construction, when the movement distance of the movable supporting member is great, the movable supporting member travels at a higher speed. Therefore, the developing speed can be increased.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
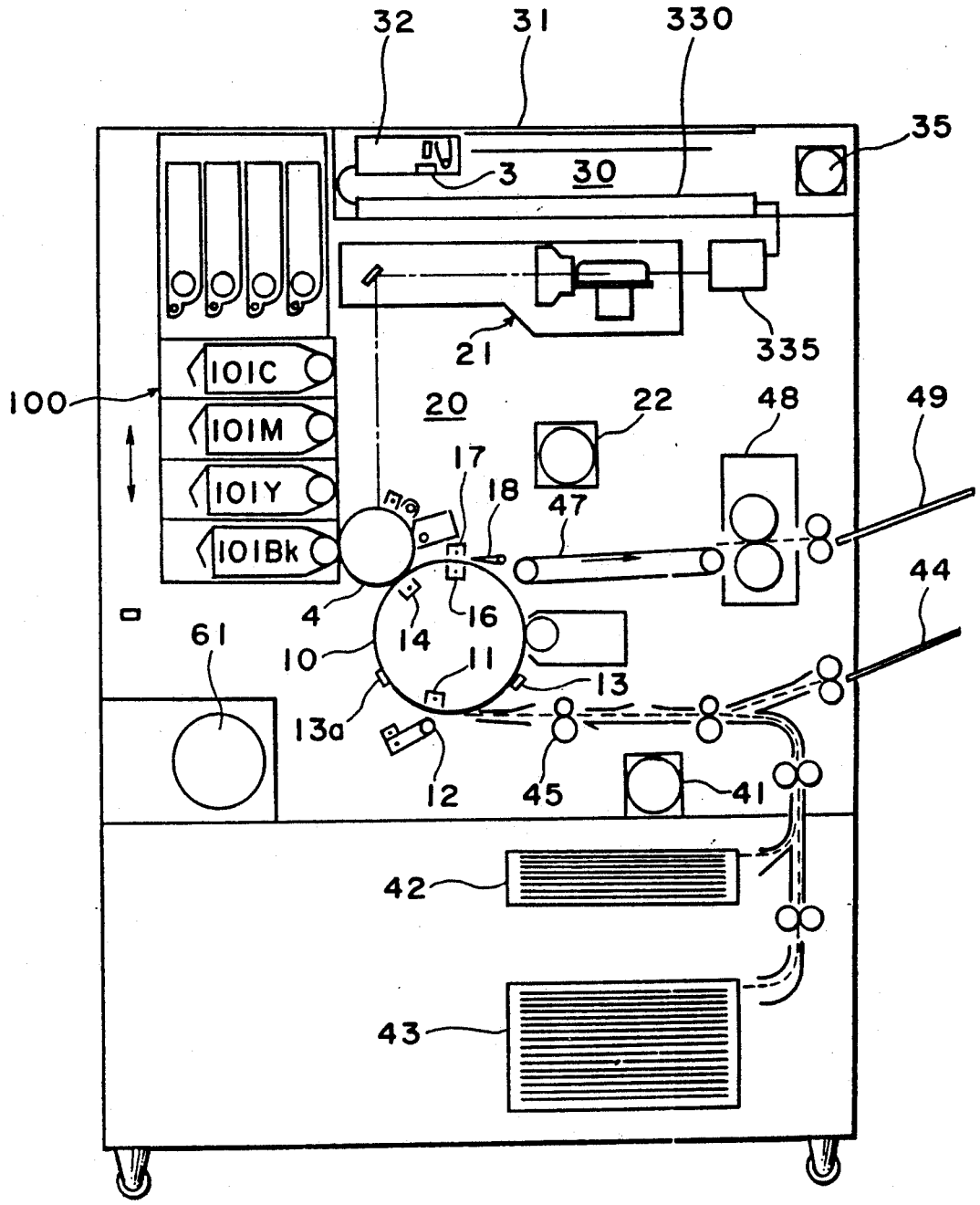
FIG. 1 is a schematic diagram showing an image forming apparatus having a developing unit according to an embodiment of the present invention.

Before the description of the present invention proceeds, it is to be noted that like parts are designated by like reference numerals throughout the accompanying drawings.

Entire structure of image forming apparatus

There is shown in FIG. 1 the structure of an image forming apparatus containing a developing unit according to the present invention.

The image forming apparatus comprises a reading section 30 and a printer section 20.

1. Reading section 30

In the reading section 30, image data is made by an image scanning operation.

That is, in the reading section 30, the image of an original document set on an original document setting base 31 is exposed and scanned by a scanner 32 so that an image sensor (CCD) 3 performs a photoelectric conversion of a light reflected by the image. Then, signals thus generated are processed by an image signal processing portion 330 to generate digital image data. The data is stored in a buffer memory 335.

The scanner 32 scans the image of the original document more than one time in accordance with a color mode set. The color mode will be described in detail later.

The scanner 32 is driven by a motor 35 to move below and along the original document setting base 31 so as to scan the image of the original document.

The output of a laser device 21 of the printer section 20 is controlled by the image data stored in the buffer memory 335. Thus, as will be described later, an electrostatic latent image is written onto a photosensitive drum 4.

2. Printer section 20

The printer section 20 comprises an image forming portion including a laser device 21, the photosensitive drum 4, and members in the periphery thereof; the developing unit arrangement; and a paper processing arrangement including a paper supply/discharge system, a transfer drum, and members in the periphery thereof.

In the image forming section, an electrostatic latent image is formed by a laser beam. The laser beam outputted from the laser device 21 scans the surface of the photosensitive drum 4 uniformly charged and rotating at a constant speed, in an axial direction, namely, in the main scanning direction. As a result, an electrostatic latent image corresponding to the image data is formed on the surface of the photosensitive drum 4.

The electrostatic latent image is developed into a toner image by the developing unit arrangement as will be described below, and the toner image is transferred to paper supplied on the surface of a transfer drum 10. The transfer drum 10 and the photosensitive drum 4 are driven by a motor 22. The transfer drum 10 and the photosensitive drum 4 rotate at the same speed. The rotational directions of the transfer drum 10 and the photosensitive drum 4 are opposite to each other.

In the developing unit arrangement, a developing device selected according to a color mode is situated at the developing position in opposition to the photosensitive drum 4, then, the electrostatic latent image is developed into a visible image with toner. In FIG. 1, a black developing device 101Bk is at the developing position.

The developing unit arrangement comprises the developing unit 100 accommodating four developing devices 101C, 101M, 101Y and 101Bk and a toner hopper, positioned above the developing unit 100, for supplying a color toner corresponding to each developing device. The four developing devices consist of a cyan developing device 101C containing cyan toner, a magenta developing device 101M containing magenta toner, a yellow developing device 101Y containing yellow toner, and a black developing device 101Bk containing black toner.

The developing unit 100 can be vertically moved by a motor 61. The mechanism and the control thereof will be described in detail later.

In the paper processing arrangement, the following operations are carried out: supply of copy paper to the transfer drum 10, winding of paper around the transfer drum 10, image fixation, and discharge of paper from the apparatus.

Paper supplied from a paper accommodating cassette 42, 43 or a hand-supply portion 44 is fed to the transfer drum 10 through feed rollers, and wound around the transfer drum 10.

Thereafter, a toner image formed on the photosensitive drum 4 is transferred to the paper. The number of transfer times is determined by setting the color mode, i.e., controlled by a variable (n) indicating the number of developing times. The developing operation will be described in detail later.

Then, the paper is released from the transfer drum 10. After the developed image is fixed to the paper by a fixing device 48, the paper is discharged to a discharge tray 49.

The following members are arranged in the vicinity of the transfer drum 10: a pair of timing rollers 45 for feeding the copy paper to the transfer drum 10 at an appropriate timing, a paper feed belt 47, an attracting charger 11 for electrostatically attracting the paper to the transfer drum 10; a paper holding roller 12, a transfer charger 14 for electrostatically attracting toner on the photosensitive drum 4 to the copy paper, dielectrifying chargers 16 and 17 for dielectrifying the transfer drum 10 so as to release the copy paper therefrom after the toner image is transferred to the copy paper, a release claw 18 for releasing the copy paper from the transfer drum 10, a sensor 13 for detecting the reference position of the transfer drum 10, and an actuator plate 13a for actuating the sensor 13.

The feed rollers and the feed belt 47 are driven by a main motor 41.

Developing unit 100

The developing unit 100 is described below with reference to FIGS. 2, 3, and 5 through 9.

Figure 2:
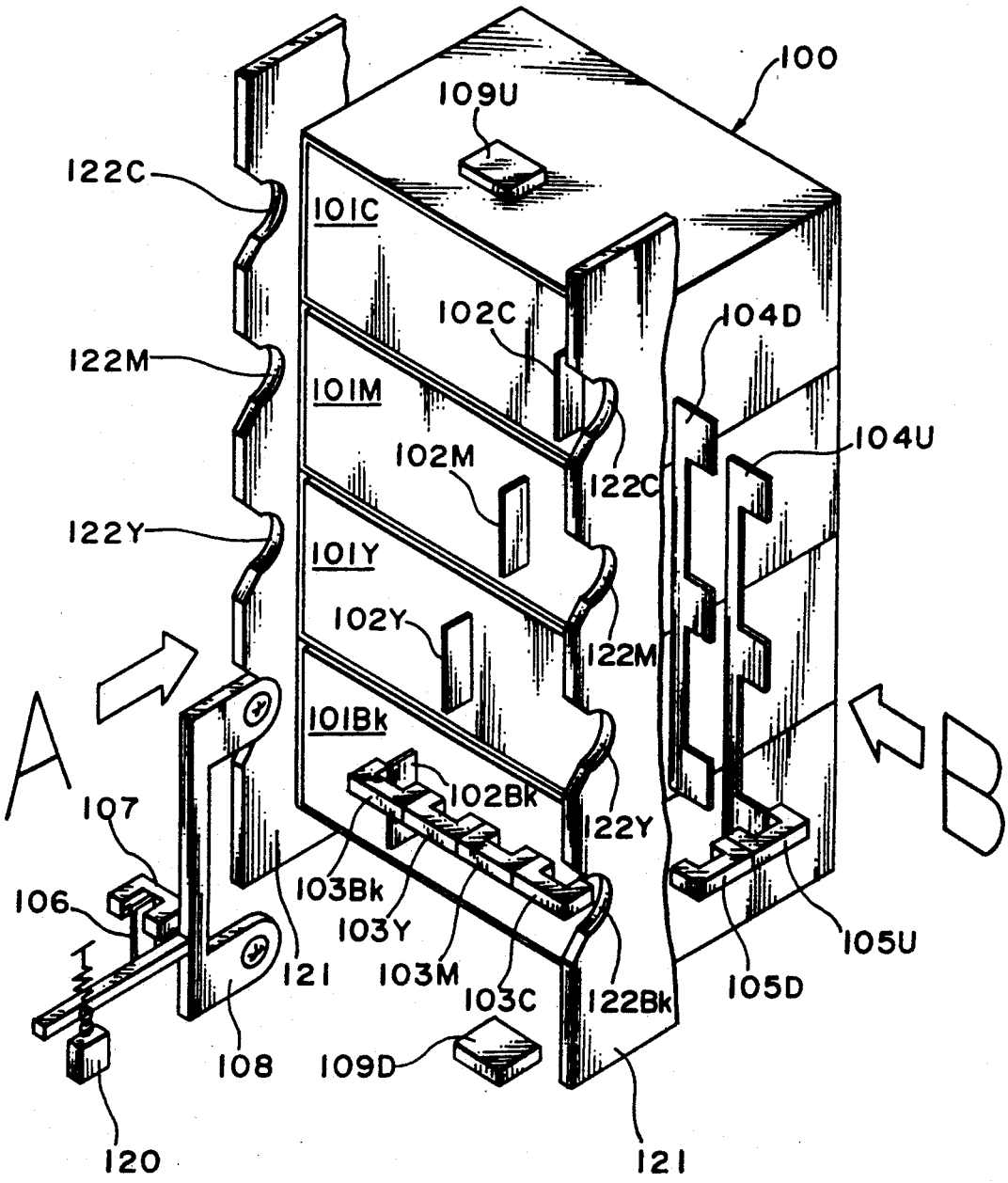
FIG. 2 is a perspective view showing the developing unit included in the apparatus.
Figure 3B:
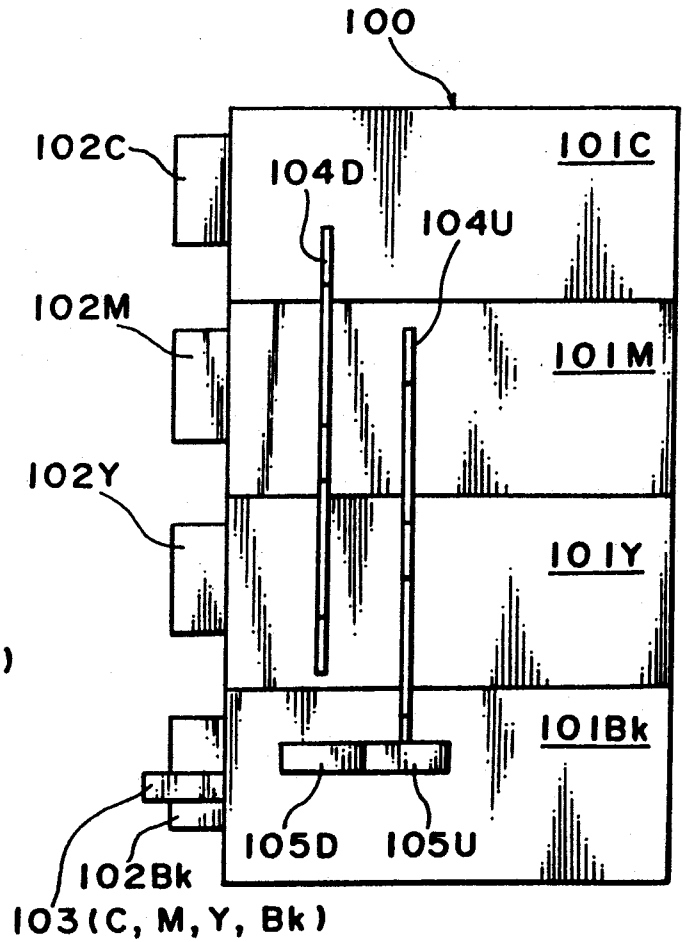
FIG. 3B is a side elevation of the developing unit, viewed in a direction indicated by an arrow B in FIG. 2.
Figure 3A:
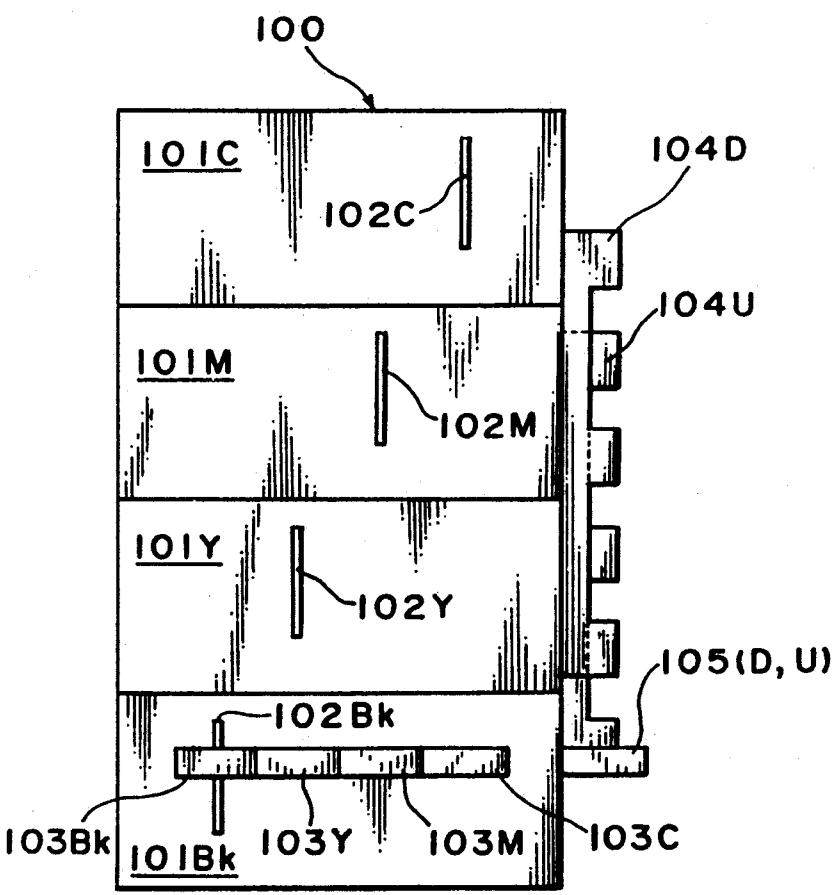
FIG. 3A is a front view of the developing unit, viewed in a direction indicated by an arrow A in FIG. 2.

1. Position detecting mechanism (FIGS. 2 and 3A)

As described previously, the developing unit 100 accommodating the four developing devices is vertically movable. That is, a developing device selected according to a color mode will be set at the developing position. As described previously, a developing sleeve is opposed to the photosensitive drum 4 at the developing position. For example, the cyan developing device 101C and the black developing device 101Bk are at the developing position in FIG. 7 and in FIGS. 2 and 3, respectively.

Developing position detecting optical sensors 103C, 103M, 103Y, and 103Bk detect which of the developing devices 101 is at the developing position.

The four sensors 103 (C, M, Y, Bk) are fixed to the main body of the apparatus at a level corresponding to the developing position such that they are positioned on the rear of the developing unit 100, namely, the side opposite to the photosensitive drum 4. In FIG. 2, the side of the developing unit 100 opposed to the photosensitive drum 4 is not seen.

Light intercepting plates 102C, 102M, 102Y, and 102Bk for intercepting the optical path of the sensors 103C, 103M, 103Y, and 103Bk, respectively when each developing device comes to the developing position are fixed to the back of each of the four developing devices 101C, 101M, 101Y, and 101Bk.

When one of the developing devices 101 is at the developing position, the light intercepting plate 102 mounted on the developing device 101 intercepts the optical path of the corresponding sensor 103, thus turning on the sensor 103. Thus, the developing device 101 at the developing position is detected.

The developing unit 100 is provided with an upper sensor 109U for detecting the developing unit 100 when it is at the highest position and a lower sensor 109D for detecting it when it is at the lowest position.

2. Brake (FIGS. 2 and 3B)

The brake timing of the movement of the developing unit 100 is detected by the following mechanism.

As shown in FIG. 2, a pair of brake optical sensors 105U and 105D are fixed to the main body of the apparatus on one of the side walls of the developing unit 100 such that the positions of the brake sensors 105U and 105D coincide with the height of the developing position. The brake sensor 105U detects the brake timing of the developing unit 100 during the upward movement thereof. The brake sensor 105D detects the brake timing of the developing unit 100 during the downward movement thereof.

A pair of light intercepting plates 104U and 104D each having three projections for intercepting the optical path of each brake sensor are mounted on the side wall on which the brake sensors 105U and 105D are provided. The light intercepting plates 104U and 104D operate when the developing unit 100 is moved upward and downward, respectively. Each projection of the light intercepting plates 104U and 104D is formed in the vicinity of on each boundary line between adjacent developing devices 101. The vertical length of the projection is 2 cm each. The projection of the light intercepting plates 104U is located 0.75 cm spaced from the corresponding boundary line. The projection of the light intercepting plate 104D is located 1.25 cm spaced from the corresponding boundary line. These numerical values are determined in consideration of the brake timing, movement distance, and movement speed of the developing unit 100.

As will be described later, according to the embodiment, the brake signal is turned on at OFF edge of the brake sensor due to the interception made by the projection nearest a developing device. The OFF edge means the time at which the brake sensor is turned off after it is turned on because the projection nearest a developing device 101 which is to be at the developing position has intercepted the optical path of the brake sensor (refer to step 707 to step S713 in FIG. 21).

Accordingly, the position and length of the projections may be changed to vary the ON timing of the brake signal for adjustment of the brake timing of the developing unit 100. It is possible to turn on the brake signal when the brake sensor is at ON edge of the brake sensor due to the interception made by the projection nearest a developing device. That is, the brake timing of the developing unit 100 is decided at step S707 according to whether or not the brake sensor 105 is at ON-edge.

According to the embodiment, as described above, the output of the brake sensor 105 is obtained by intercepting the optical path thereof. Thus, the movement distance of the developing unit 100 is found as will be described later. However, the movement distance of the developing unit 100 may be found based on a light transmitted from a slit alternatively provided at a position corresponding to the projection.

3. Locking mechanism (FIGS. 2 and 8)

After the developing unit 100 is vertically moved and reaches a desired position, it is locked by the following mechanism, with a selected developing device located at the developing position.

Locking member receiving plates 121 are fixed to both side walls of the developing unit 100 at the rear thereof.

Figure 8A:
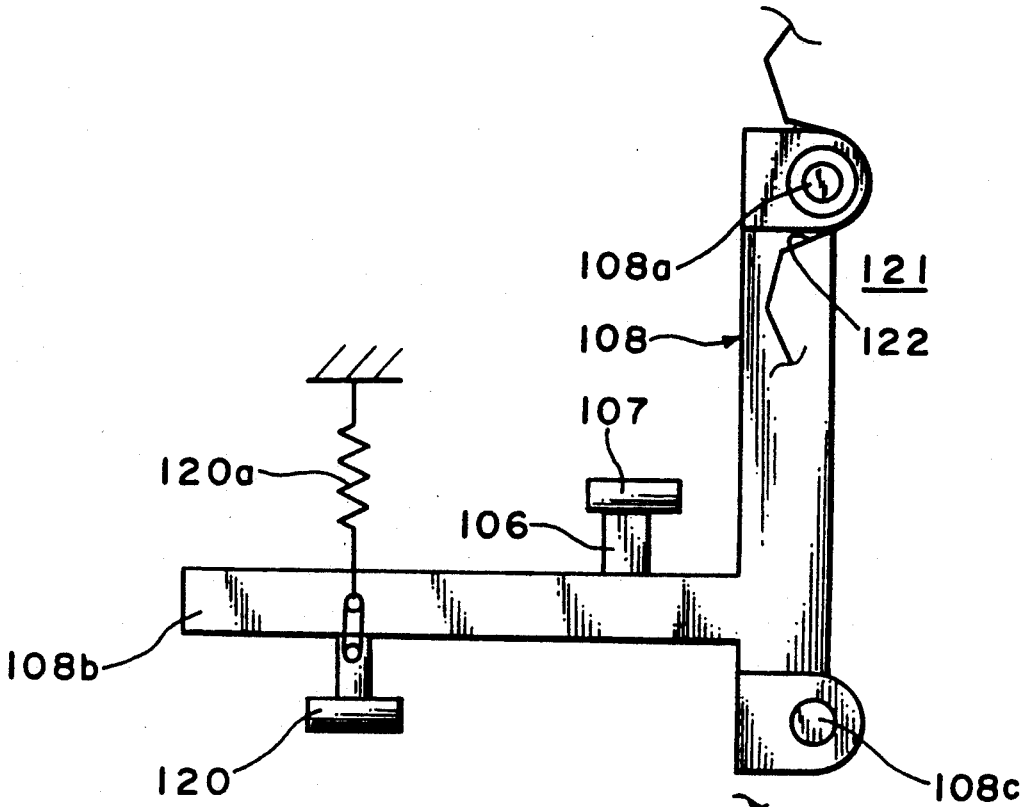
FIG. 8A is a side elevation showing a locking mechanism included in the developing unit which is locking the developing unit.

The plate 121 has cut-away portions 122C, 122M, 122Y, and 122Bk, formed at a level corresponding to the position of each developing device 101, for receiving one end **108*a* of a locking member 108. After the developing unit 100 is vertically moved in a predetermined distance, one end 108*a* of the locking member 108 engages one of the cut-away portions 122C, 122M**, 122Y, and 122Bk as shown in FIGS. 2 and 8a. As a result, the developing unit 100 is locked. The interval between each center of adjacent cut-away portions is 6.5 cm and the vertical length of each developing device 101 is 6 cm, in the embodiment.

The locking member 108 is approximately L-shaped and the other end 108b thereof is urged upward by a spring 120a. That is, the elastic force of the spring 120a pivots the locking member 108 clockwise about the supporting point. As a result, the end 108a of the locking member 108 penetrates into one of the cut-away portions 122C, 122M, 122Y, and 122Bk, as shown in FIG. 8A. Consequently, one of the developing devices 101 (C, M, Y, and Bk) is locked at the developing position.

Figure 8B:
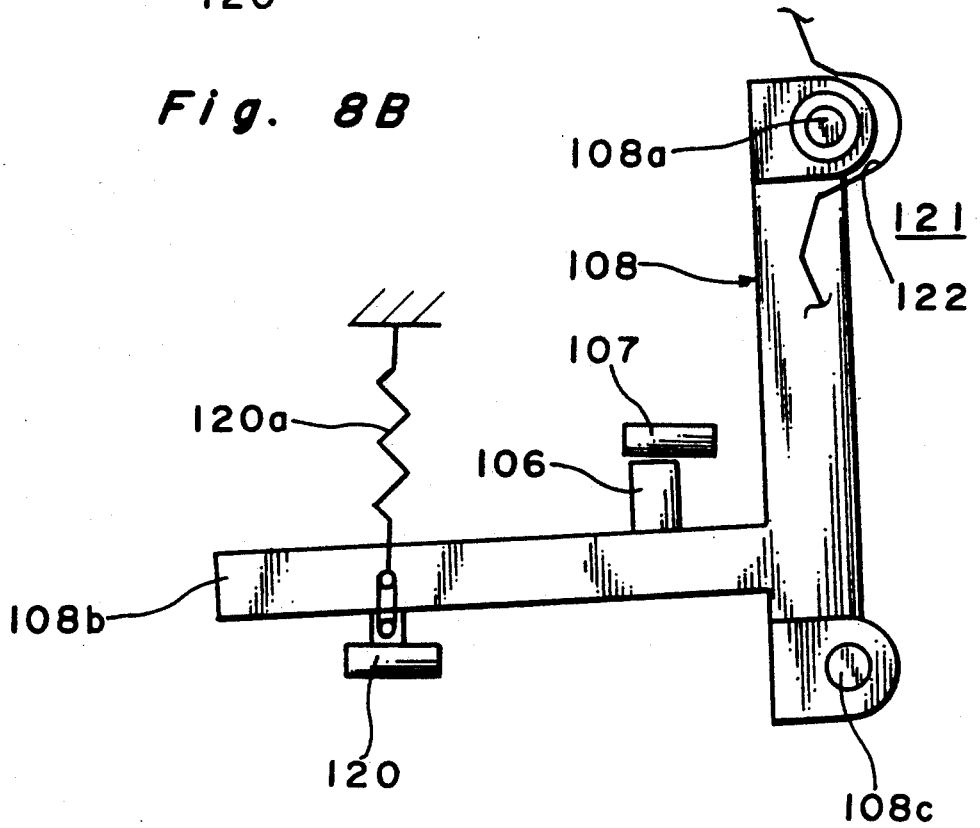
FIG. 8B is a side elevation showing a locking mechanism which is unlocking the developing unit.

An unlocking solenoid 120 provided opposite to the spring 120a with respect to the locking member 108 operates to move one end 108a of the locking member 108 away from the cut-away portion 122 (C, M, Y, and Bk). That is, when the solenoid 120 is turned on, the other end 108b of the locking member 108 is attracted downward. As a result, as shown in FIG. 8B, one end 108a of the locking member 108 moves away from the cut-away portion 122 (C, M, Y, and Bk). Thus, the developing unit 100 is unlocked.

A lock sensor 107 fixed to the main body of the apparatus detects whether or not the locking member 108 is fitted into the cut-away portion 122. When the locking member 108 is fitted into the cut-away portion 122, the light intercepting plate 106 fixed to the locking member 108 moves into the lock sensor 107 as shown best in FIG. 1, thus intercepting the optical path of the lock sensor 107. As a result, the lock sensor 107 is turned on. When the locking member 108 is not fitted into the cut-away portion 122, the optical path of the lock sensor 107 is not intercepted. As a result, the lock sensor 107 is turned off.

4. Pressing mechanism (FIGS. 5, 6, 7, and 9)

After the locking member 108 engages the cut-away portion 122, the selected developing device 101 is pressed against the photosensitive drum 4 by a pressing device 200 which is described below. After a development is carried out, the developing device 101 is released from the photosensitive drum 4 by the pressing device 200.

Figure 5:
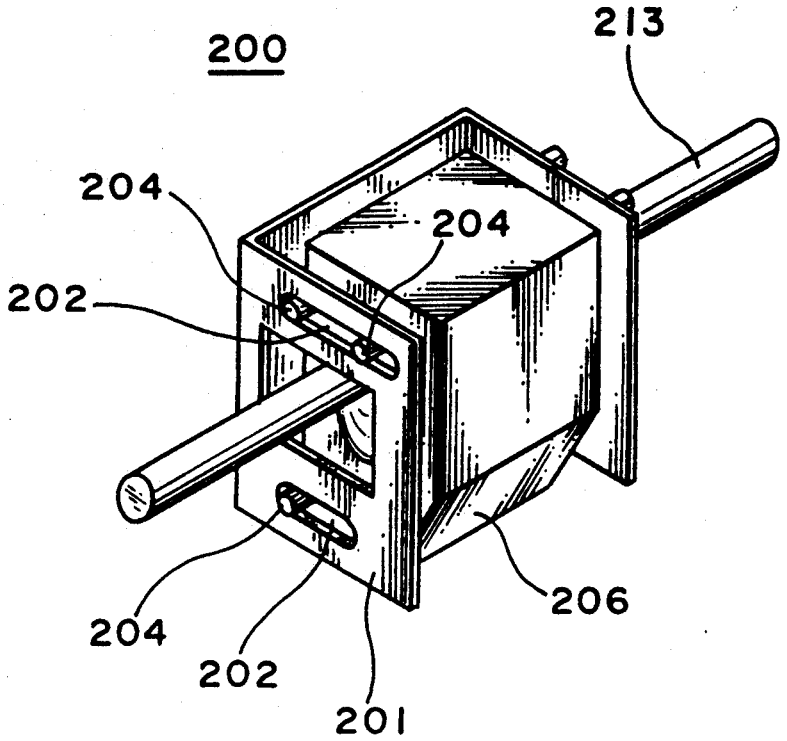
FIG. 5 is a perspective view showing a pressing mechanism included in the developing unit.
Figure 6:
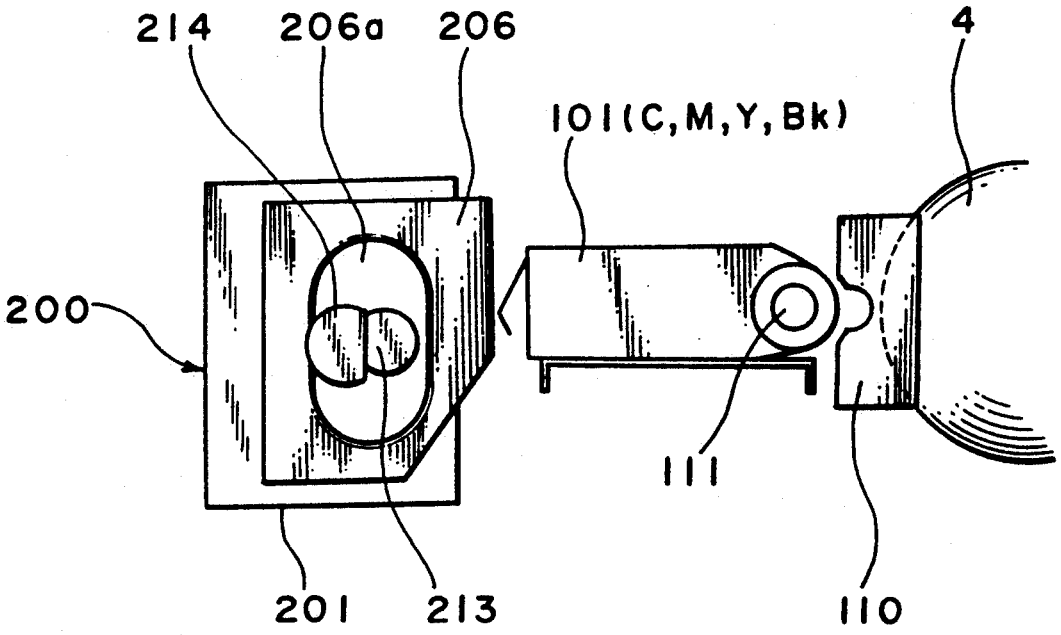
FIG. 6 is a side elevation showing a condition in which the pressing mechanism dose not press one developing device included in the developing unit.
Figure 7:
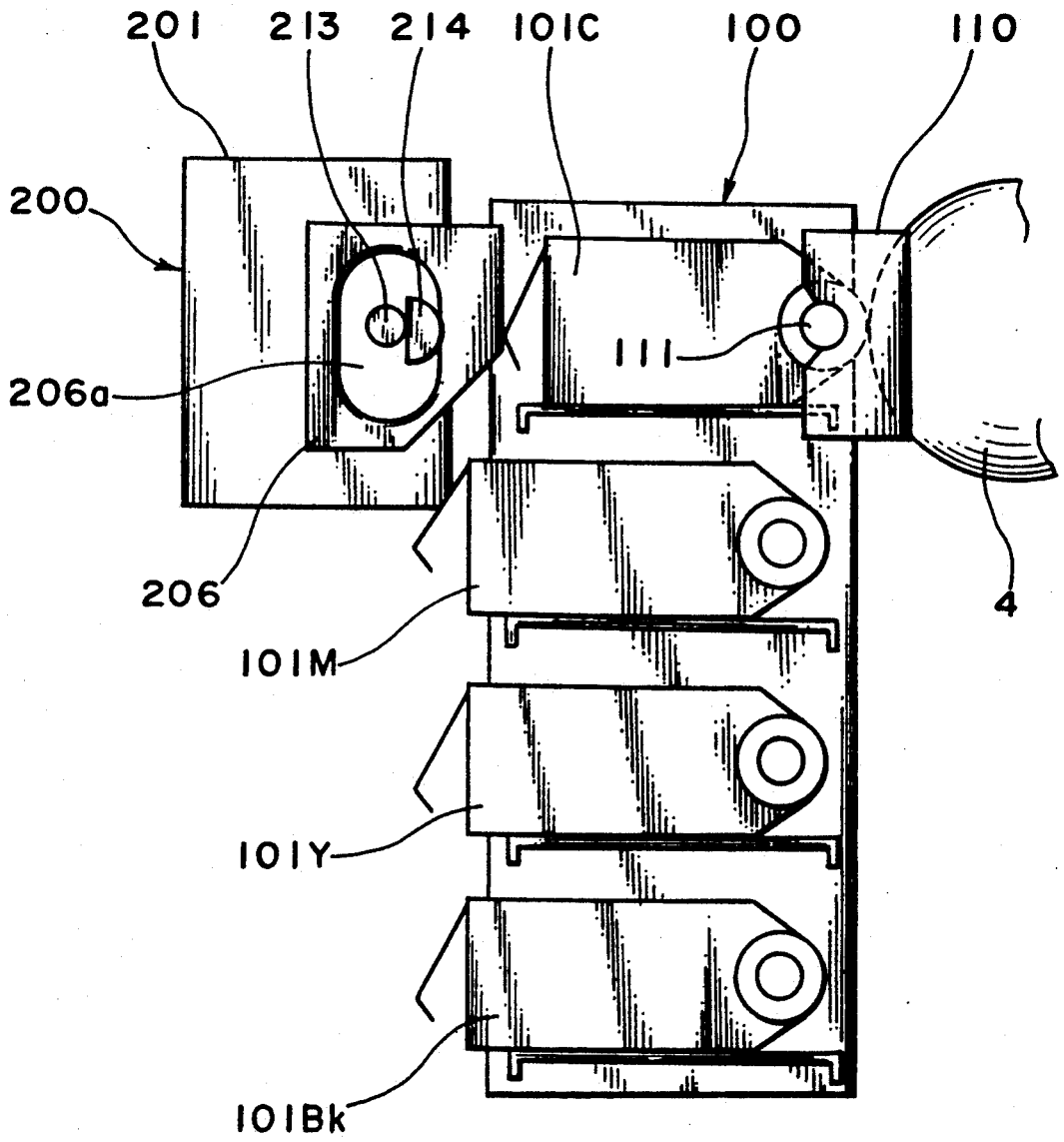
FIG. 7 is a side elevation showing a condition in which the pressing mechanism presses one developing device.

As shown in FIGS. 5, 6, and 7, the pressing device 200 having a pressing cam 206 is positioned in the rear of the developing device 101 situated at the developing position. In FIG. 7, the cyan developing device is at the developing position.

The pressing device 200 presses the developing device 101 against the photosensitive drum 4 and releases it therefrom according to the displacement of the pressing cam 206.

The pressing device 200 comprises a frame 201 fixed to the main body of the apparatus, three slide pins 204 slidably inserted in upper and lower through-holes 202 formed in the flame 201, a pressing cam 206 held in the flame 201 by the three slide pins 204, a round shaft 213 extending through a through-hole 206a of the pressing cam 206 and the flame 201, and an eccentric cam 214 fixed on the peripheral surface of the round shaft 213.

Figure 9A:
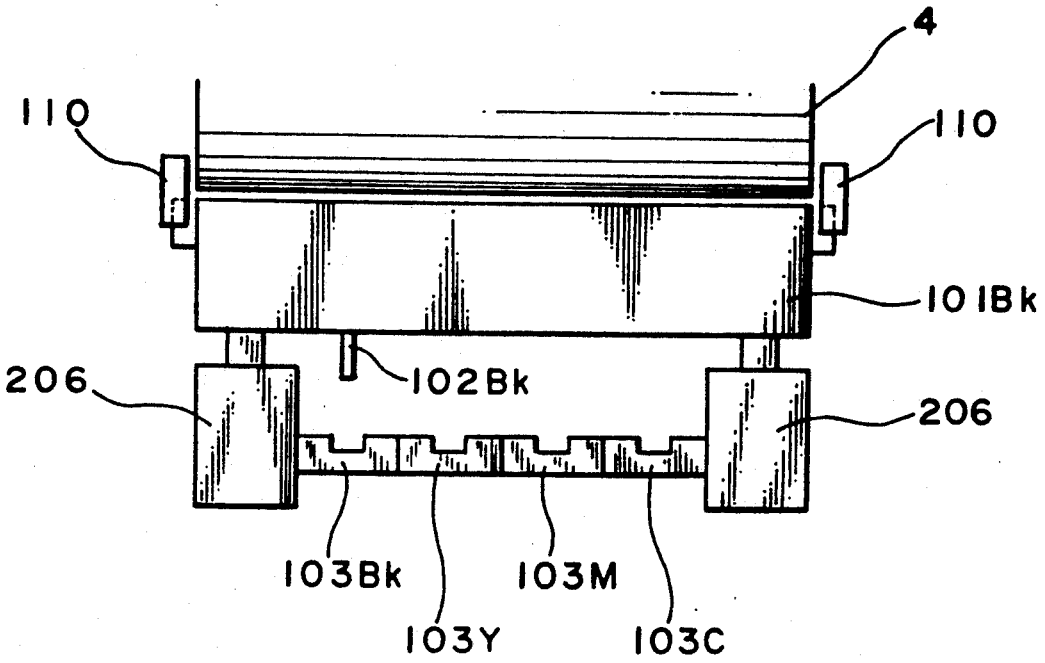
FIG. 9A is a top plan view showing a condition in which one developing device is pressed against a photosensitive drum.

When the selected developing device 101 is pressed against the photosensitive drum 4, the round shaft 213 is driven by a solenoid (not shown) for pressing the developing device 101 against the photosensitive drum 4. That is, when the solenoid is turned on, the shaft 213 rotates 180° clockwise together with the cam 214. As a result, the position of the eccentric cam 214 is switched from a position, namely, the left of the shaft 213 as shown in FIG. 6 shown in FIG. 7. Consequently, the inner wall of the through-hole 206a is pressed to the right by the eccentric cam 214. That is, the pressing cam 206 is moved to the right as shown in FIG. 7. Thus, the developing device 101 is pressed against the photosensitive drum 4. At this time, as shown in FIG. 9A, the light intercepting plate 102Bk moves away from the sensor 103Bk. That is, when the developing device 101Bk is pressed against the photosensitive drum 4 in the developing position, the sensor 103Bk is turned off. FIG. 9 is a plan view showing the developing device 101 at the developing position and the photosensitive drum 4.

Figure 9B:
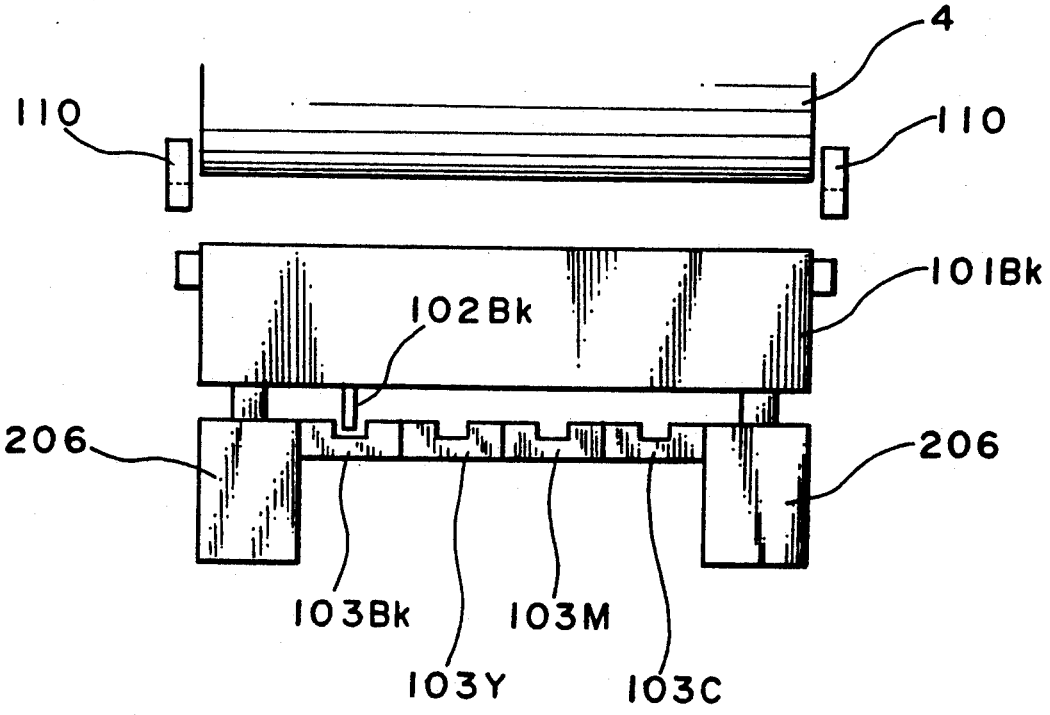
FIG. 9B is a top plan view showing a condition in which one developing device is away from the photosensitive drum.

When the developing device 101 is released from the photosensitive drum 4, an operation reverse to the above is carried out. More specifically, when the solenoid for pressing the developing device against the photosensitive drum 4 is turned off, the shaft 213 rotates 180° counter-clockwise. As a result, the eccentric cam 214 revolves 180° about the shaft 213, i.e., the position of the eccentric cam 214 is switched from the right position as shown in FIG. 7 to the left position as shown in FIG. 6. Consequently, the inner wall of the through-hole 206a is pressed to the left by the eccentric cam 214. That is, the pressing cam 206 is moved to the left as shown in FIG. 7. Thus, the developing device 101 is released from the photosensitive drum 4. At this time, as shown in FIG. 9B, the light intercepting plate 102Bk penetrates into the sensor 103Bk. That is, with the release of the developing device 101Bk from the photosensitive drum 4, the sensor 103Bk is turned on again.

A roller 111 coaxial with the developing sleeve is stopped by a stopper 110 mounted in the vicinity of the photosensitive drum 4. Thus, the developing device 101 is pressed against the photosensitive drum 4 by the pressing member 200.

Control circuit

Figure 4:
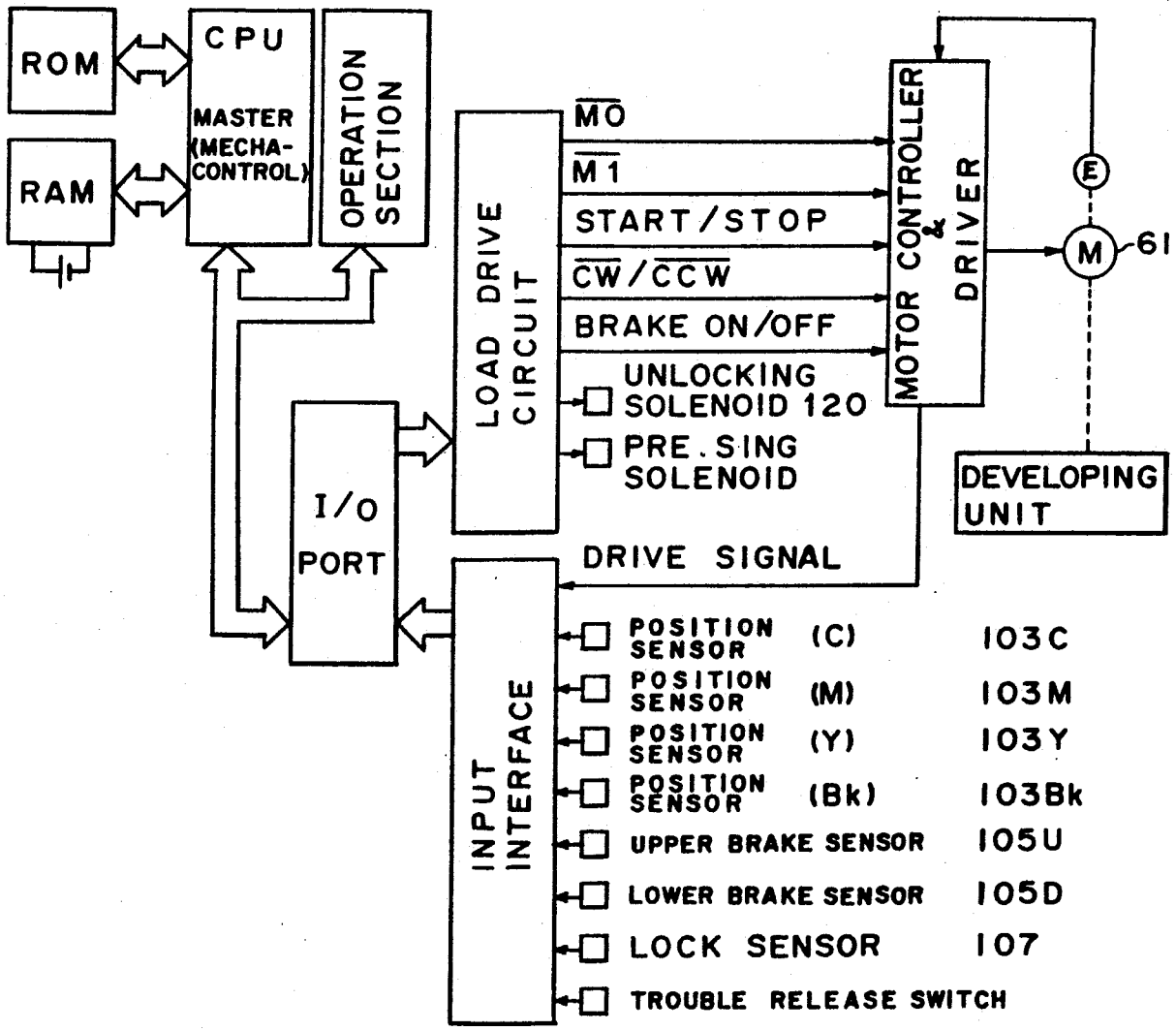
FIG. 4 is a circuit diagram for controlling the developing unit.
Figure 10:
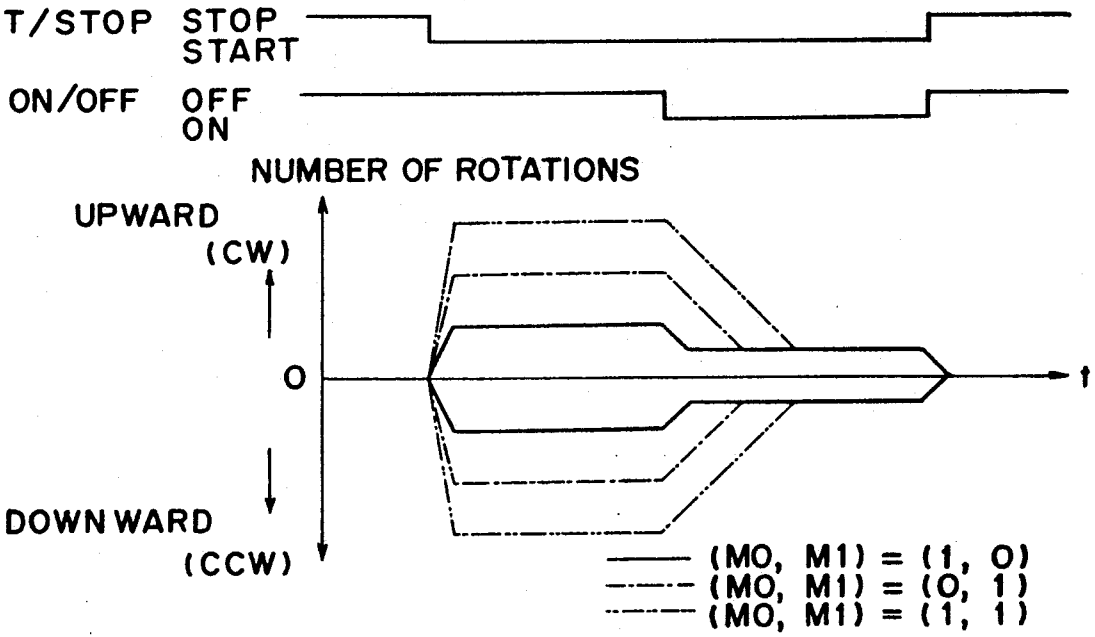
FIG. 10 is a time chart showing a relation between a rotational speed of an elevator motor and controlling signals.

The structure of circuits for controlling the movement, stop, and pressing of the developing unit 100 against the photosensitive drum 4 are described below with reference to FIGS. 4, 10, and 11. The operation of the developing unit 100 is controlled by a master CPU.

The CPU is connected with a ROM which stores the control program thereof, a RAM functioning as the working area, and an operation section for receiving inputs through keys (not shown) mounted on an operation panel (not shown).

The following signals are inputted to the CPU through an I/O port and an input interface: signals outputted from sensors, namely, the sensors 103C, 103M, 103Y, and 103Bk for detecting which of the developing devices 101 is at the developing position; the brake sensors 105U and 105D for detecting the brake timing of the developing unit 100; the lock sensor 107 for detecting whether or not the developing device is locked; and a trouble release switch 106. The following signals are outputted from the CPU through the I/O port and a load drive circuit: signals (M0, M1, START/STOP, CW/CCW, brake ON/OFF) for controlling the elevator motor 61; a signal for turning on and off the unlocking solenoid 120; and a signal for turning on/off the solenoid for pressing the developing device 101 against the photosensitive drum 4.

Figure 20:
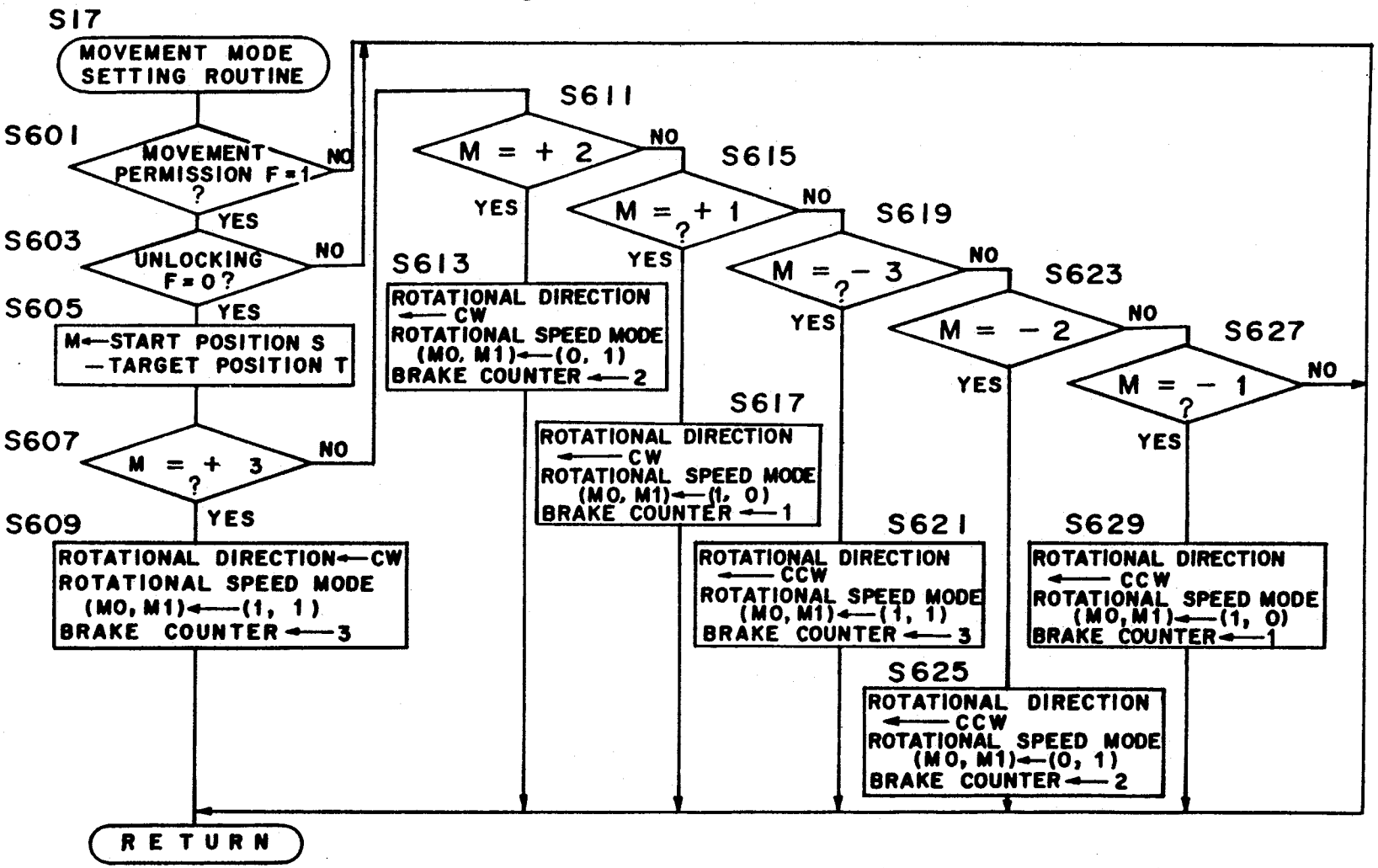
FIG. 20 is a flowchart showing the movement mode setting routine corresponding to Step 17 in FIG. 12.

The signals M0 and M1 controlling the rotational speed of the elevator motor 61 are set according to the distance of the developing unit 100 as shown in FIG. 20.

If the developing unit 100 is moved one unit in distance, M1 and M0 are set to 0 and 1, respectively. In this case, the rotational speed of the motor 61 is low as shown by the solid line in FIG. 10.

If the developing unit 100 is moved by two unit distances, M1 and M0 are set to 1 and 0, respectively. In this case, the rotational speed of the motor 61 is intermediate as shown by the one-dot chain line in FIG. 10.

If the developing unit 100 is moved by three unit distances, M1 and M0 are set to 1 and 1, respectively. In this case, the rotational speed of the motor 61 is high as shown by the two-dot chain line in FIG. 10.

The movement of one unit distance means that the developing device 101 nearest the developing position is moved thereto.

The START/STOP signal controls the drive and stop of the motor 61. As shown in FIG. 10, the motor 61 is driven when the START/STOP signal is at the low level (START).

The CW/CCW signal controls the rotational direction of the motor 61. That is, the developing unit 100 is moved upward when the CW/CCW signal is at the low level (CW) and upward when it is at the high level (CCW).

The brake ON/OFF signal is outputted from the CPU to brake the motor 61. As shown in FIG. 10, the motor 61 is braked when the brake ON/OFF signal is at the low level (ON).

Figure 11:
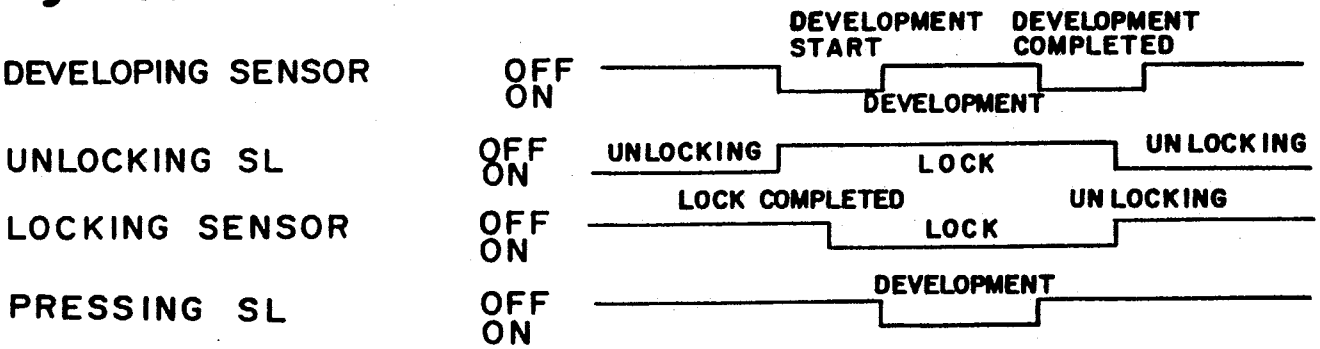
FIG. 11 is a time chart showing an operation of the developing unit.

The signal for turning on and off the unlocking solenoid 120 and the signal for turning on and off the solenoid for pressing the developing device 101 against the photosensitive drum 4 are active at the low level as shown in FIG. 11.

Processing by CPU

The control to be made by the CPU for positioning the developing unit 100 and the developing device 101 will be described below.

The expression of "ON edge" which are used in the description made below means the switching of a signal from OFF to ON. Similarly, "OFF edge" means the switch of a signal from ON to OFF.

A. Main routine

Figure 12:
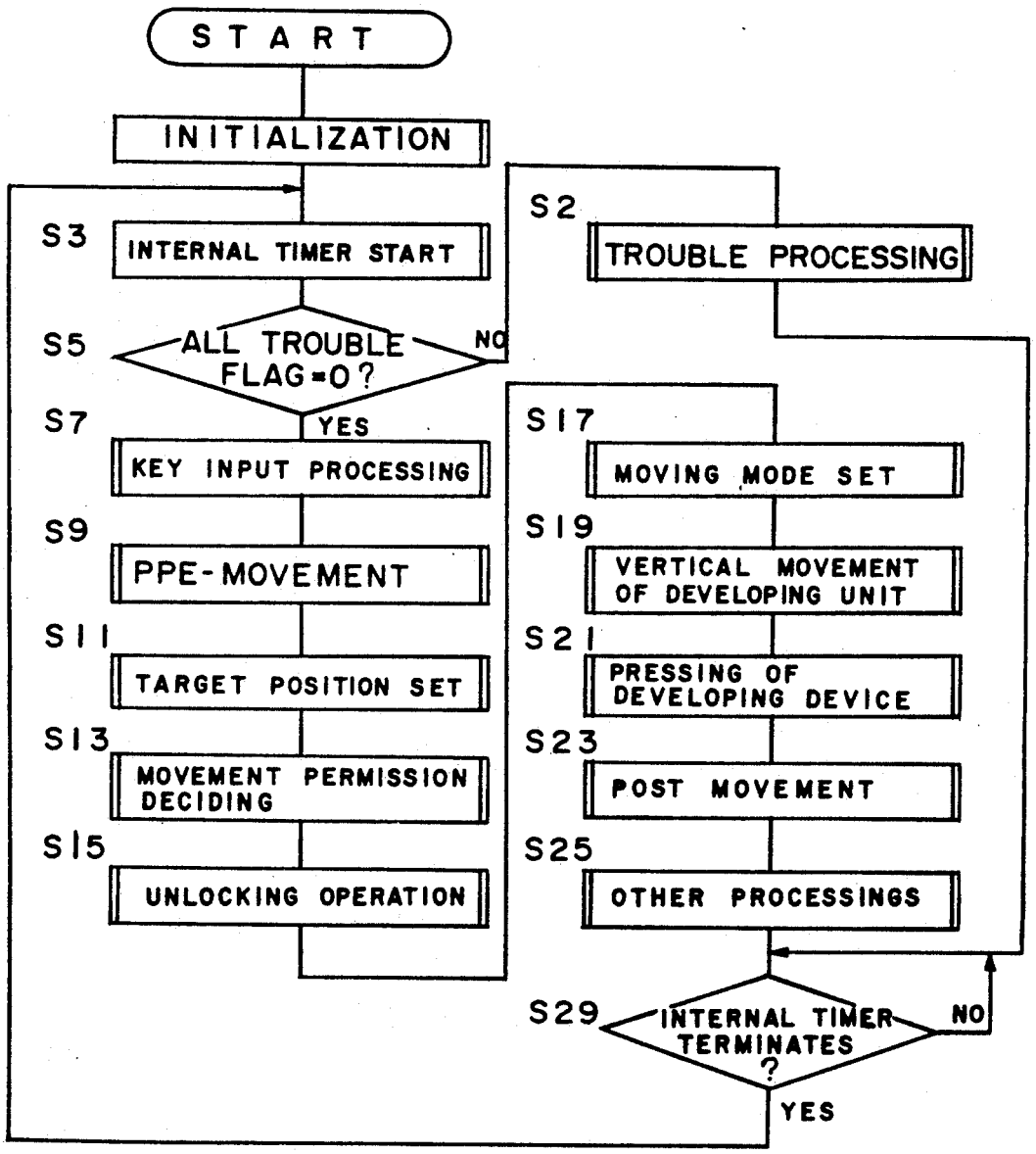
FIG. 12 is a flowchart showing a main routine to be used by a CPU included in FIG. 4.

FIG. 12 is a flowchart showing the main routine to be used by the CPU to execute processing.

The CPU starts processing upon switch-on of the power source. First, at step S1, the initialization such as the clearances of flags are executed.

Thereafter, at step S3, an internal timer for managing the execution time of one routine is started. Then, the program goes to step S5 at which it is decided whether or not all trouble flags are reset to "0". If yes, the processing of each of the following subroutines (Steps 7–25) is executed.

Step 7: Key input processing routine for performing a control according to inputs through keys.

Step 9: Pre-movement routine for moving the developing unit 100 to the home position before a copying operation is performed.

Step 11: Target position setting routine for setting data indicating the target position of the developing unit 100 according to a color mode set.

Step 13: Movement deciding routine for deciding whether or not the developing unit 100 can move and whether or not it is necessary for the developing unit 100 to move.

Step 15: Unlocking routine for unlocking the developing unit 100 by operating the unlocking solenoid 120.

Step 17: Moving mode setting routine for setting data of the rotational direction, number of rotations, and brake timing of the motor 61.

Step 19: Developing unit moving routine for moving the developing unit 100 to the target position.

Step 21: Developing device pressing routine for pressing the developing device against the photosensitive drum 4 and unlocking it therefrom after a developing operation is carried out.

Step 23: Post-movement routine for returning the developing unit 100 to the home position after a copying operation is performed.

Step 25: Other processings for executing processings other than the above processings.

After the above processings are executed, the CPU waits for the termination of the internal timer at step S29. Then, the CPU returns to step S3 to continue executing processings.

If it is decided at step S5 that any one of the trouble flags is set, the program goes to step S27 at which a processing for the trouble is executed.

B. Subroutine

FIGS. 13 through 24 are flowcharts showing processings to be executed in subroutines of each main routine. Each subroutine is described below.

1. Key input routine (FIGS. 13 through 15)

Figure 13:
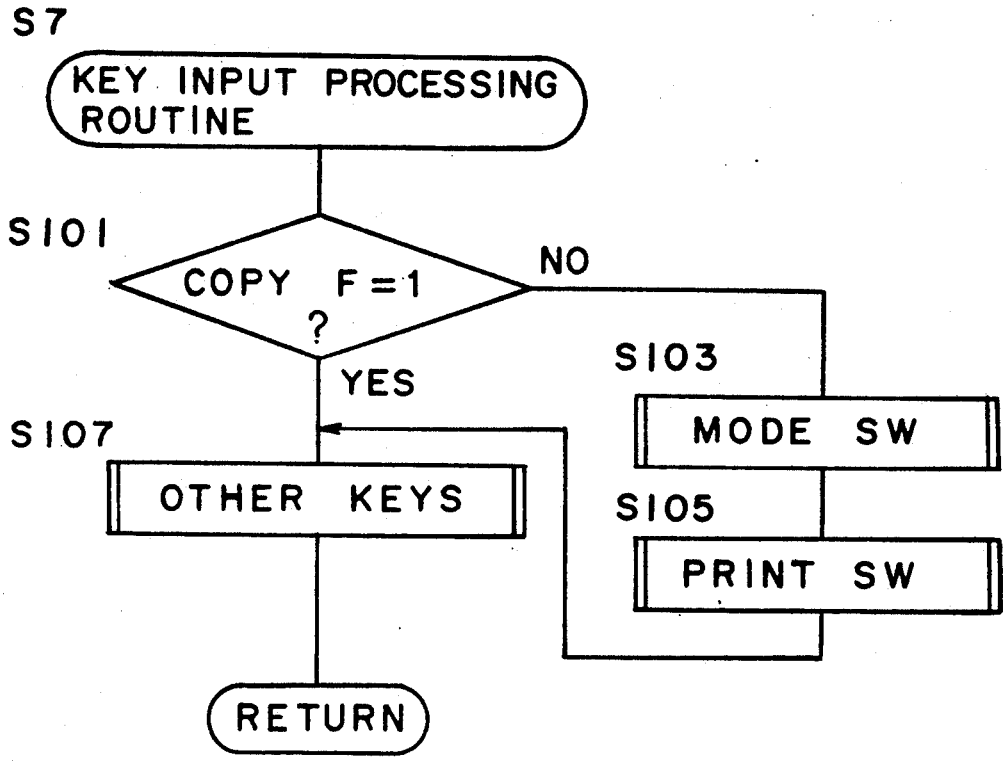
FIG. 13 is a flowchart showing the key input routine corresponding to Step 7 in FIG. 12.
Figure 14:
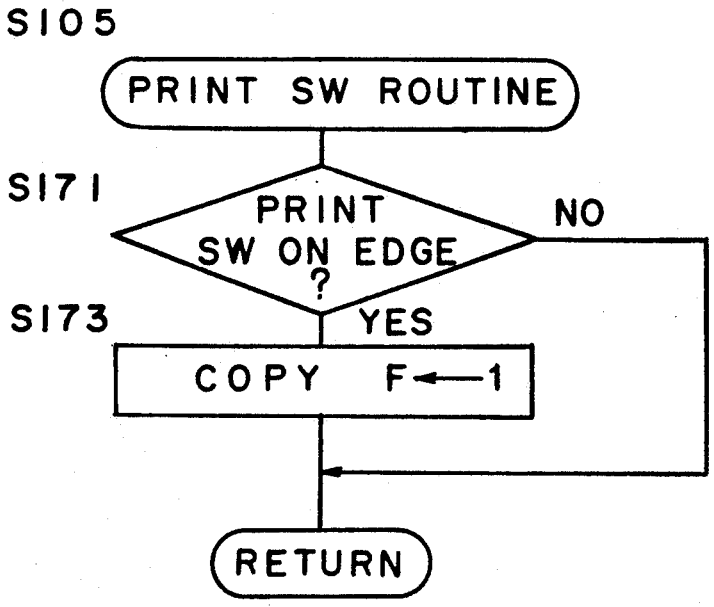
FIG. 14 is a flowchart showing the print routine corresponding to Step 105 in FIG. 13.

In the subroutine of key input routine, if it is decided at step S101 that a copy flag is reset to "0", i.e., if it is decided that a copy operation is not carried out, the program goes to steps S103 and S105 at which appropriate processings are executed, as shown in FIG. 13. If it is decided at step S101 that the copy flag is set to "1", the program goes to step S107 at which a processing according to an input through a key is executed.

In the print switch routine, if it is decided at step S171 that the print switch is at ON edge, the copy flag is set to "1", as shown in FIG. 13.

Figure 15:
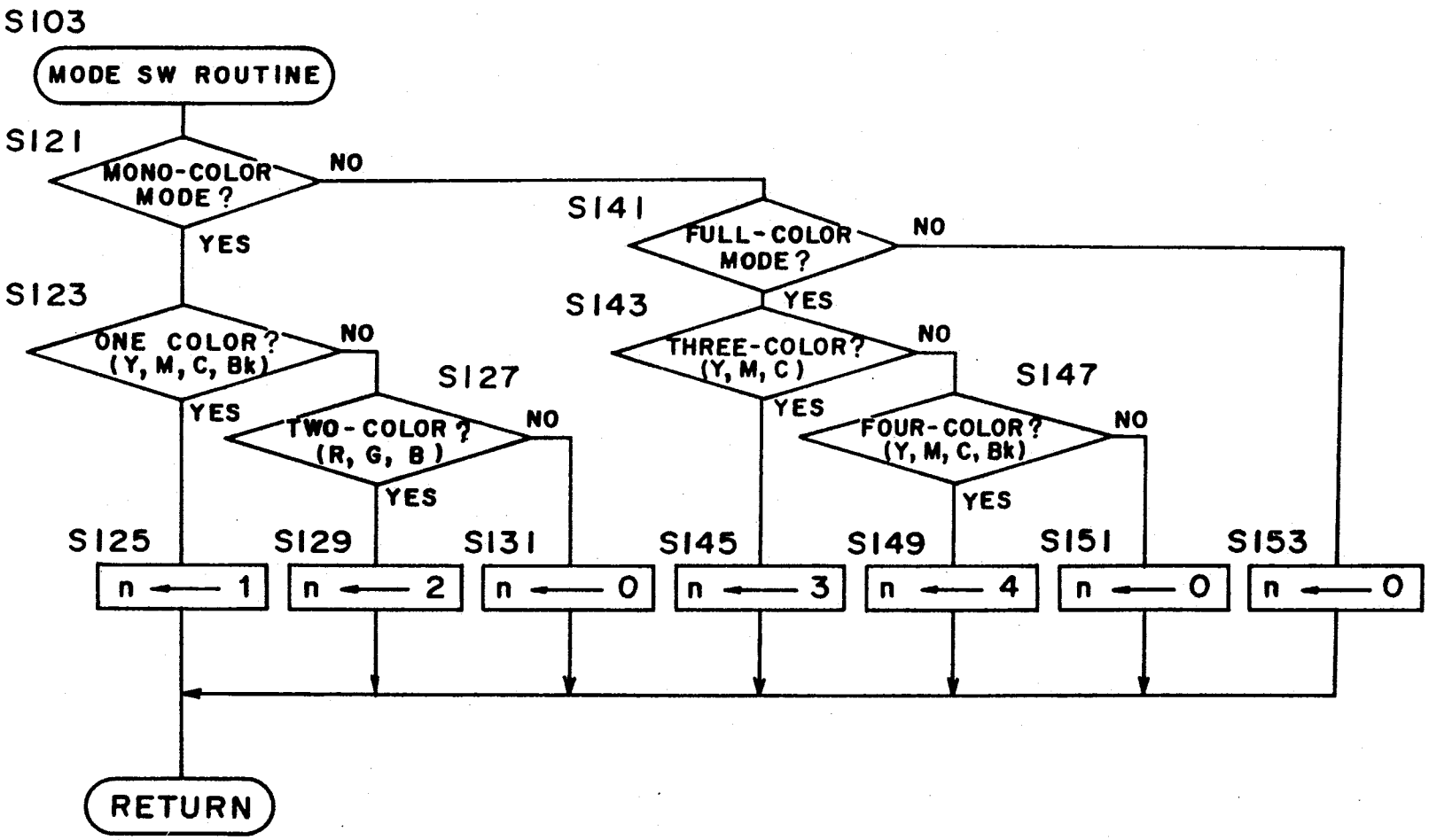
FIG. 15 is a flowchart showing the mode routine corresponding to Step 103 in FIG. 13.

Referring to FIG. 15, in the mode switch routine, the initialization data of the number (n) of developing times is set according to a color mode set by the mode switch. The number of developing times is a counter variable indicating the number of developing operations to be carried out on the same copy paper.

If it is decided that mono-color mode is set (yes at step S121 and S123), the number of developing times is set to "1" as initialization data at step S125. The mono-color mode is the mode for forming a copied image in one color selected from yellow, magenta, cyan, or black. The mono-color mode is hereinafter referred to as one color mode.

If two-color synthesized mode is set (yes, at step S121, no, at step S123, and yes at step S127), the number of developing times (n) is set to "2" as initialization data at step S129 because two developing devices are used. The two-color synthesized mode is the mode for forming a copied image in one color by synthesizing two colors selected from yellow, magenta, and cyan. The following colors are synthesized R (red): yellow+magenta
G (green): yellow+cyan
B (blue): magenta+cyan The two-color synthesized mode is hereinafter referred to as two-color mode.

If three-color mode is set (yes at step S141 and yes at step S143), the number of developing times (n) is set to "3" as initialization data at step S145 because three developing devices other than black developing device 101Bk are used. The three-color synthesized mode is hereinafter referred to as three-color mode.

If four-color mode is set (yes at step S141, no at step S143, yes at step S147), the number of developing times (n) is set to "4" as initialization data at step S149 because four developing devices are used. The four-color synthesized mode is hereinafter referred to as four-color mode.

If none of the above color modes are set (no at step S127 or no at step S141 or no at step S147), the number of developing times n) is set to "0" as initialization data at step S131, S151, and S153). In this case, a developing operation is not carried out.

Figure 16:
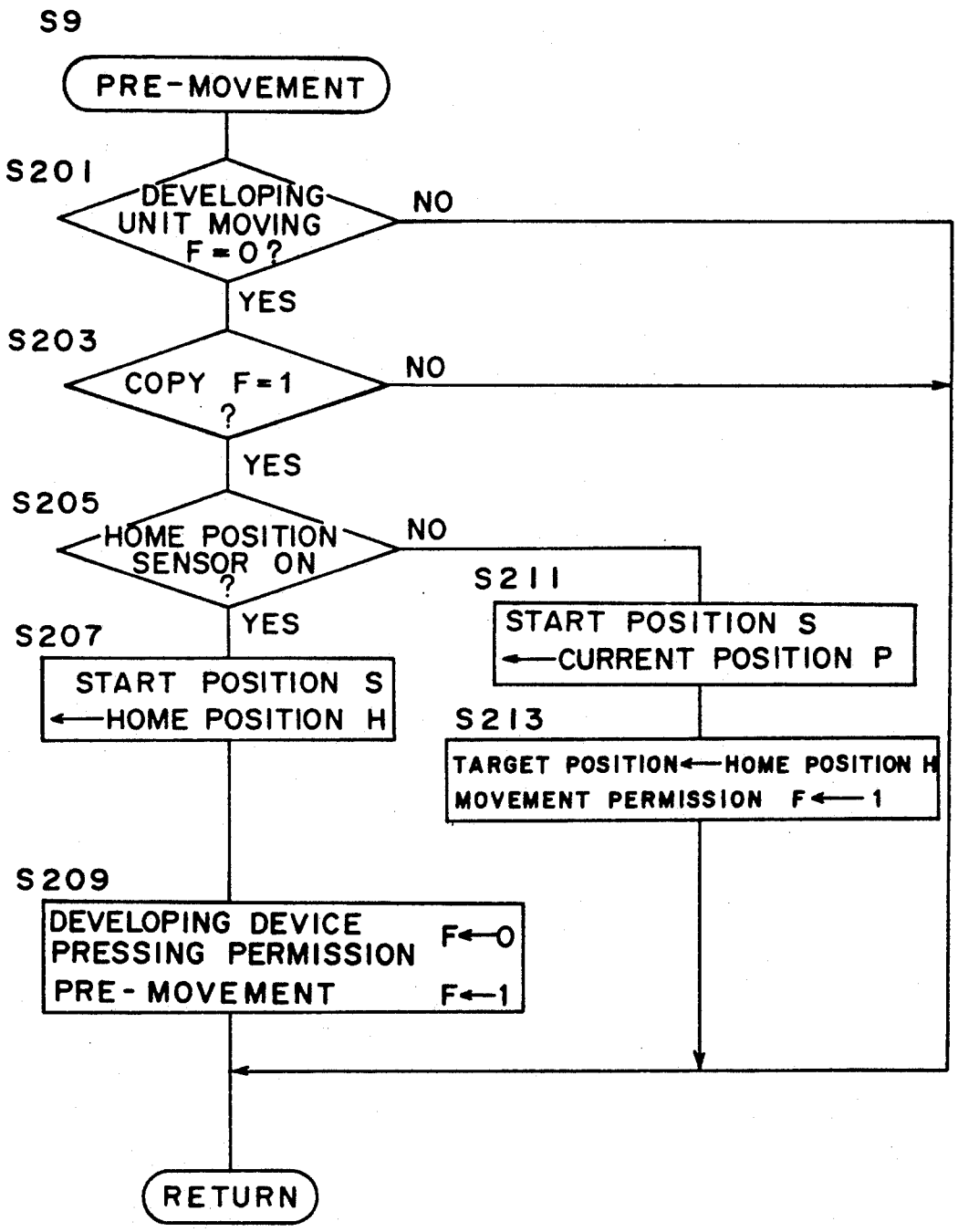
FIG. 16 is a flowchart showing the pre-movement routine corresponding to Step 9 in FIG. 12.
Figure 17A:
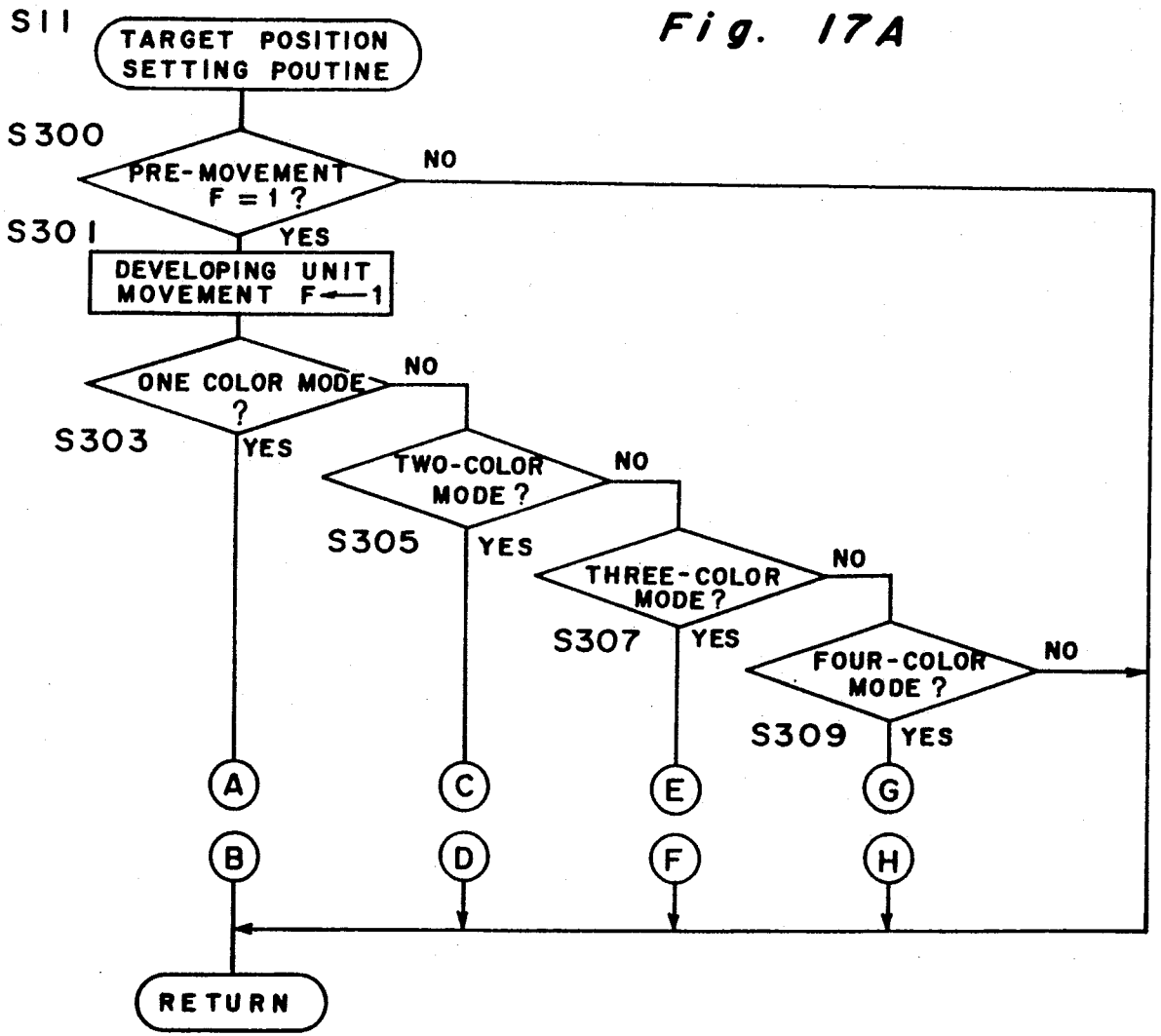
FIGS. 17A-E are a flowchart showing the target position setting routine corresponding to Step 11 in FIG. 12.
Figure 17B:
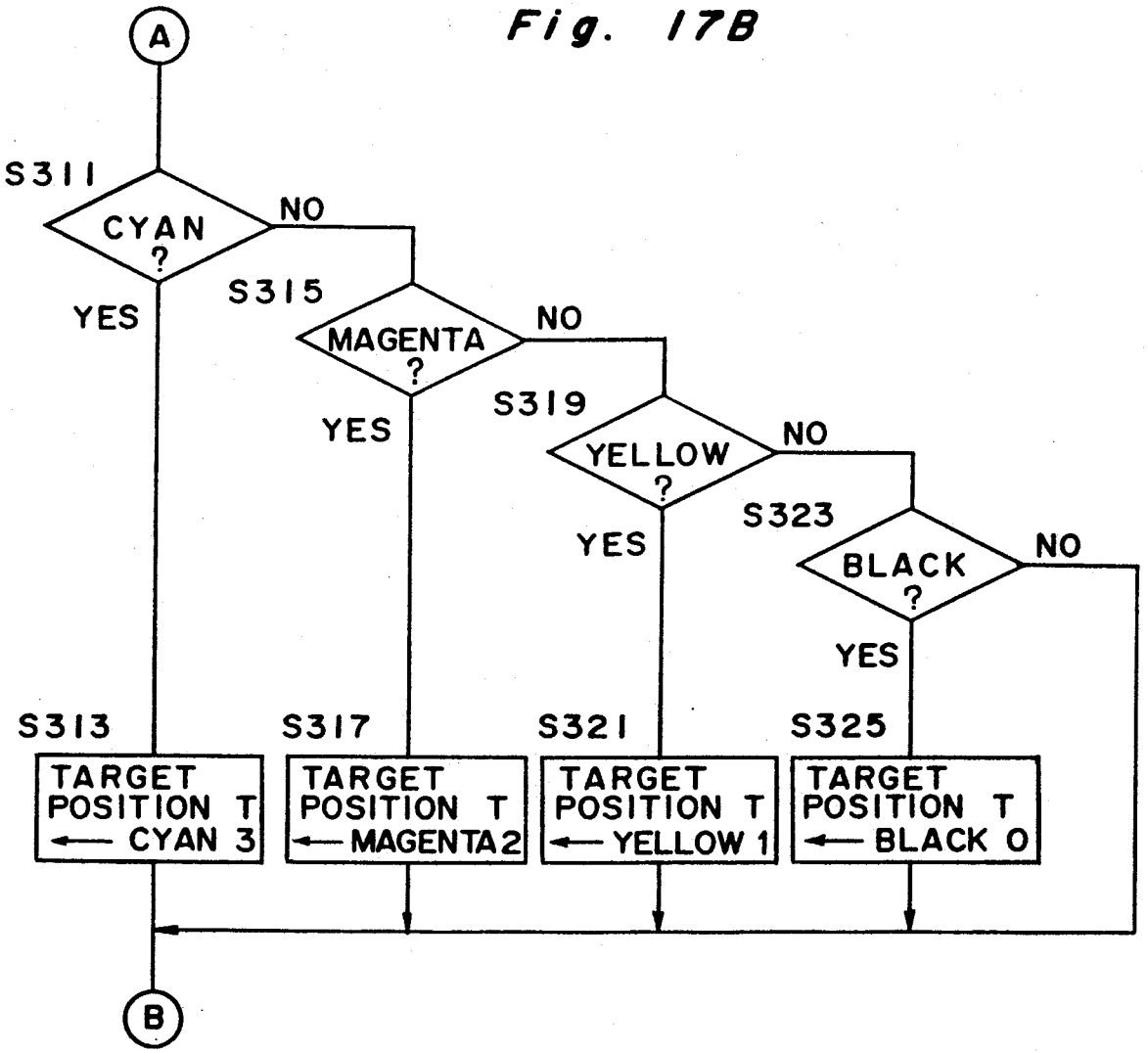
Figure 17C:
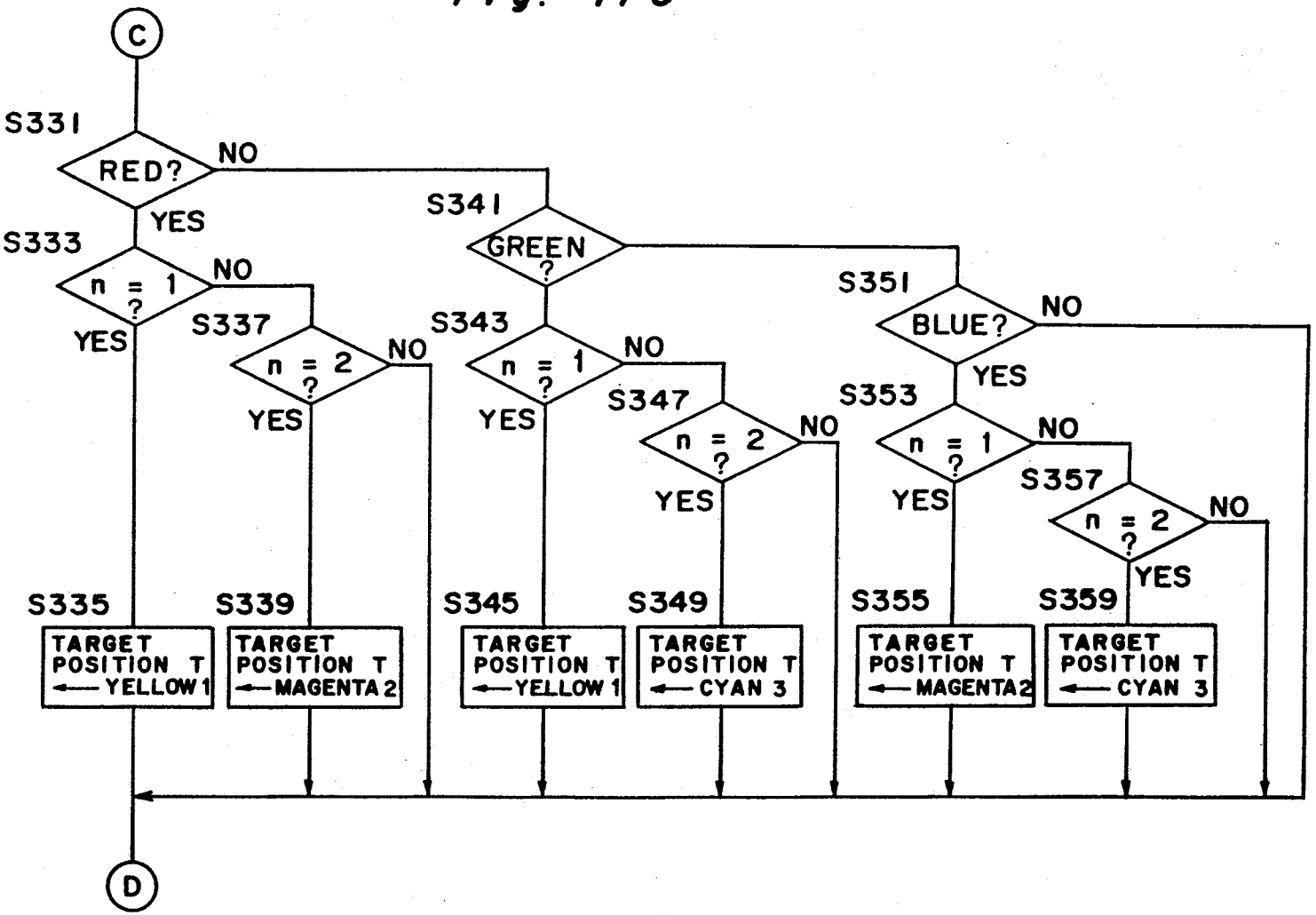
Figure 17D:
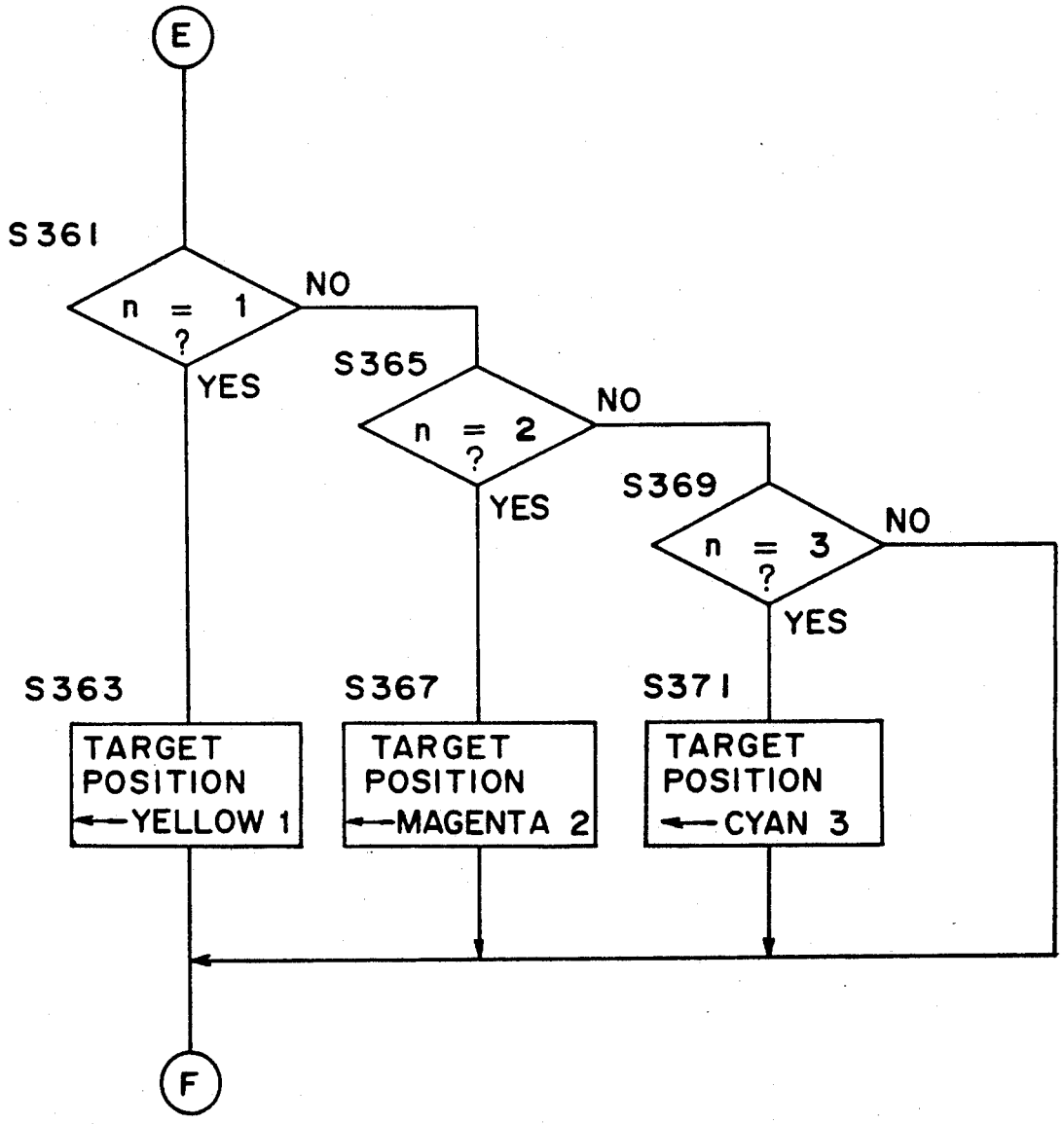
Figure 17E:
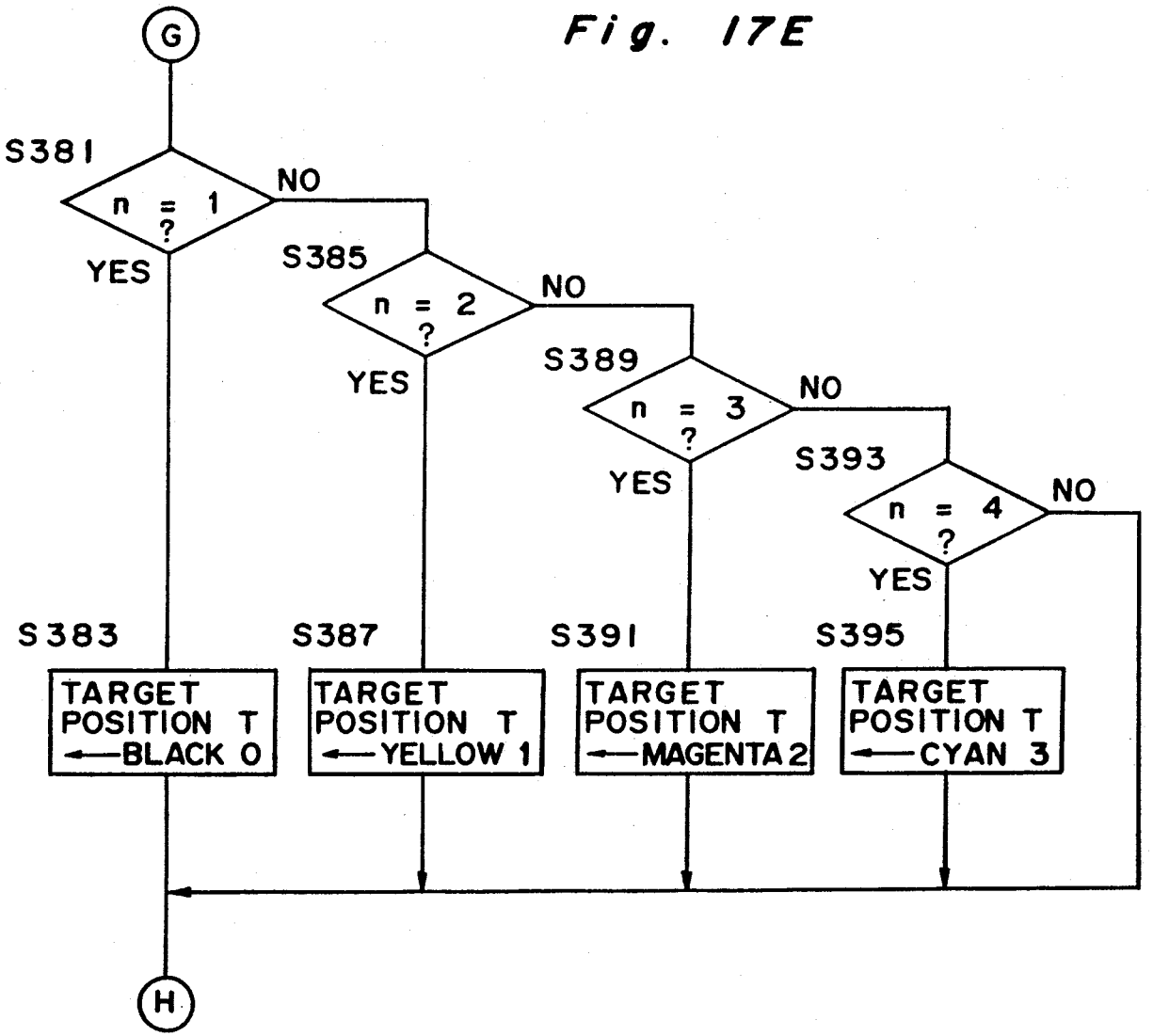

2. Pre-movement routine (FIG. 16)

In this subroutine, the processing for returning the developing unit 100 to the home position is executed to facilitate the toner supply from the toner hopper before a copying operation is performed. At the home position, the black developing device 101Bk mounted on the lowest stage of the developing unit 100 is at the developing position, i.e., the developing unit 100 is located highest.

First, it is decided at step S201 whether or not a developing unit moving flag indicating whether or not the developing unit 100 is moving or a developing operation is being carried out is reset to "0". If yes, it is decided at step S203 whether or not the copy flag is set to "1". If yes, it is decided at step S205 whether or not the developing unit 100 is at the home position.

If no at step S205, the developing unit 100 is returned to the home position. At step S211, "current position P" is set on "start position S" serving as the starting point in moving the developing unit 100. "Current position P" is the position to be detected by the sensor 103Bk, 103Y, 103M, and 103C. As "current position P", a numerical value corresponding to each sensor is substituted into "start position S". That is, O for 103Bk, 1 for 103Y, 2 for 103M, and 3 for 103C. Then, at step S213, "home position H (103Bk=0) " is set on "target position T" and a movement permission flag is set to "1" to allow the movement of the developing unit 100.

If it is decided at step S205 that the developing unit 100 is at the home position, i.e., if it is at the home position before or after the processing is executed at step S211 through S213, "home position H (103Bk=0)" is set on "start position S" in preparation for the movement of the developing unit 100 to be made for the subsequent developing operation at step S207. At step S209, a developing device pressing permission flag is reset to "0" and a pre-movement flag indicating whether or not the developing unit 100 has returned to the home position is set to "1".

The processing for controlling the movement of the developing unit 100 is described later.

3. Setting of target position (FIG. 17)

In this subroutine, data of the developing device 101 is set on "target position T" according to a color mode.

If it is decided at step S300 that the developing unit 100 has been returned to the home position by the pre-movement processing, the developing unit moving flag is set to "1" at step S301. Then, each of the following processings is executed according to a color mode set at step S303, S305, S307, and S309, respectively.

(i) One-color mode

If it is decided at step S303 that one-color mode is set, data of the developing device 101 corresponding to a selected color mode is set on "target position T" at steps S311 through S325.

If it is decided at step S311 that cyan is selected, "3" corresponding to the number of the cyan developing device 101C is set on "target position T".

Similar processings are executed at steps S315 to S317 for magenta, at steps S319 and S321 for yellow, and at steps S323 to S325 for black.

That is, if magenta is set, "2" is set on "target position T" at step S317. If yellow is set, "1" is set thereon at step S321. If black is set, "0" is set thereon at step S325.

(ii) Two-color mode

If it is decided at step S305 that two-color mode is set, data corresponding to colors set and data of developing devices 101 corresponding to the number of developing times (n) are set at the data of "target position T" at step 331 through step S359.

If it is decided at step S331 that red is set, the developing devices of magenta and yellow are used. Therefore, in the first (n=2) development, it is decided at step S333 that "1" is not set on "target position T" and it is decided at step S337 that "2" is set thereon. In the second development (n=1), it is decided at step S333 that "1" is set thereon.

Similar processings are executed at steps S341 to S359 for green and blue.

That is, if green is set, it is decided at step S349 that "3" is set thereon in the first (n=2) development, and it is decided at step S345 that "1" is set thereon in the second development (n=1). If blue is set, it is decided at step S359 that "3" is set thereon in the first (n=2) development, and it is decided at step S355 that "2" is set thereon in the second development (n=1).

(iii) Three-color mode

If it is decided at step S307 that the three-color mode is set, data of developing devices corresponding to the number of developing times (n) is set on "target position T" at step S361 through step S371.

In the first development (n=3), "3" is set thereon at step S371 through step S369. In the second development (n=2), "2" is set thereon at step at S365 through step S367. In the third development (n=1), "1" is set thereon at step S361 through step S363.

(iv) Four-color mode

If it is decided at step S309 that the four-color mode is set, data corresponding to the number of developing times (n) is set on "Target position T".

Similarly to the processing of the three-color mode, in the first (n=4) to third (n=2) development, "3" (n=4) is set on "target position T" at step S395 through steps S381, S385, S389, and S393, "2" (n=3) is set thereon at step S391 through steps S381, S385 and S389, and "1" (n=2) is set thereon at step S387 through steps S381 and S385.

In the fourth (n=1) development, "0", namely, the number of the black developing device 101Bk is set thereon at step S381 through step S383.

Figure 18:
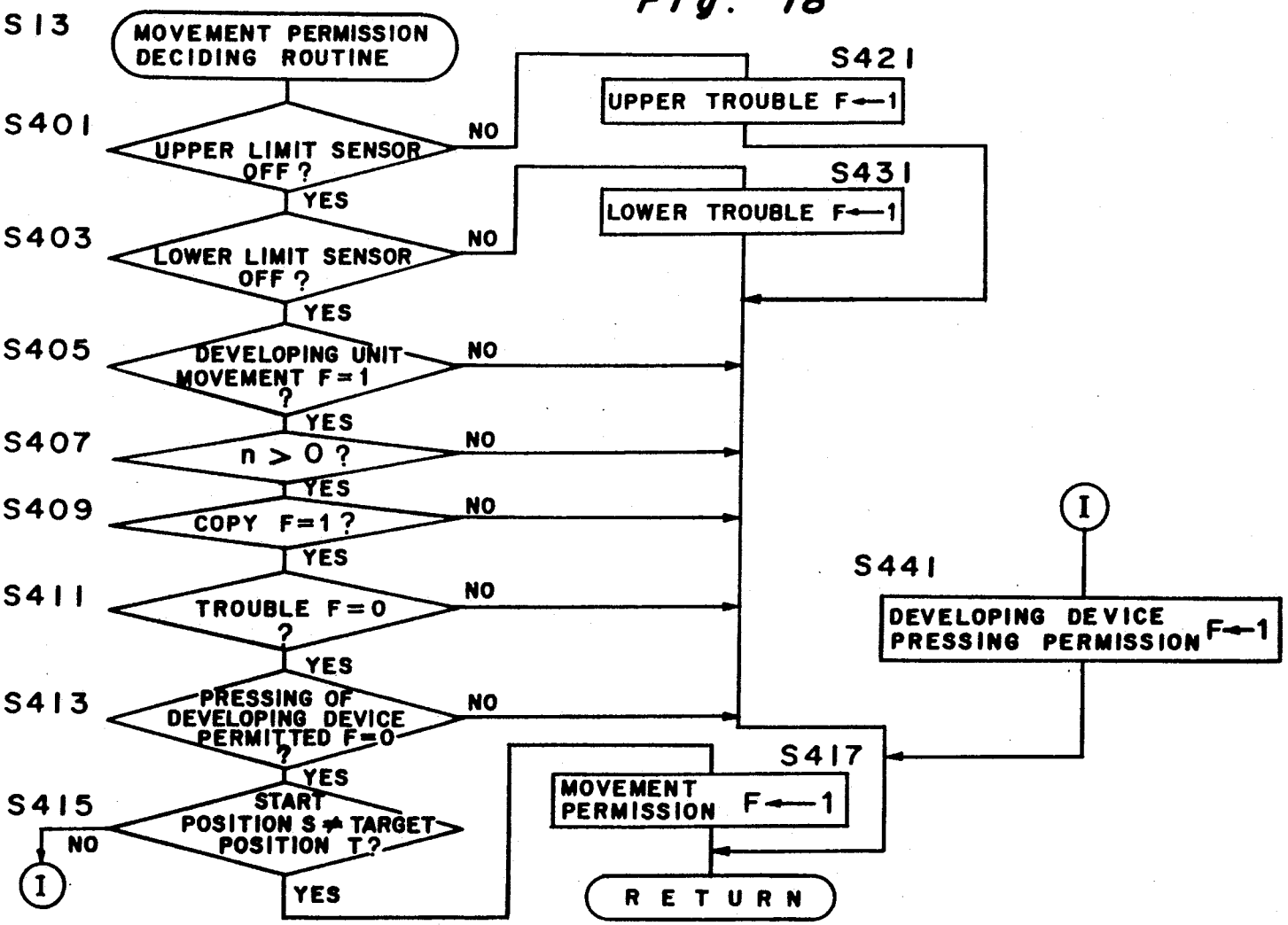
FIG. 18 is a flowchart showing the movement permission deciding routine corresponding to Step 13 in FIG. 12.

4. Decision of movement permission (FIG. 18)

In this subroutine, the timing for starting the movement of the developing unit 100 is decided before a developing operation for each color mode starts.

The program goes to step S405 if it is decided according to signals outputted from the upper sensor 109U (step S401) and the lower sensor 109D (step S403) that the developing unit 100 is positioned in its normal movement range.

It is decided at step S405 through step S413 whether or not the developing unit 100 is allowed to move.

The program goes to step S415 in the following condition: it is decided at step S405 that the developing unit moving flag is set to "1"; at step S407, the number of developing times (n) is a positive integer, namely, not 0; the copy flag is set to "1" at step S409; trouble flags are reset to "0" at step S411; and the processing for moving the developing unit 100 does not terminate, i.e., the developing device pressing permission flag is reset to "0".

It is decided at step S415 whether or not it is necessary to move the developing unit 100.

That is, if it is decided at step S415 that "start position S" and "target position T"coincide with each other, the operation for pressing the developing device against the photosensitive drum 4 can be immediately started because it is unnecessary to move the developing unit 100. Therefore, a developing device pressing permission flag is set to "1" at step S441.

If it is decided at step S415 that "start position S" and "target position T" do not coincide with each other, a movement permission flag is set to "1" to permit the developing unit 100 to start moving.

If it is decided at step S401 that the upper sensor 109U is ON, an upper trouble flag is set to "1" at step S421. If it is decided at step S403 that the lower sensor 109D is ON, a lower trouble flag is set to "1" at step S431.

Figure 19:
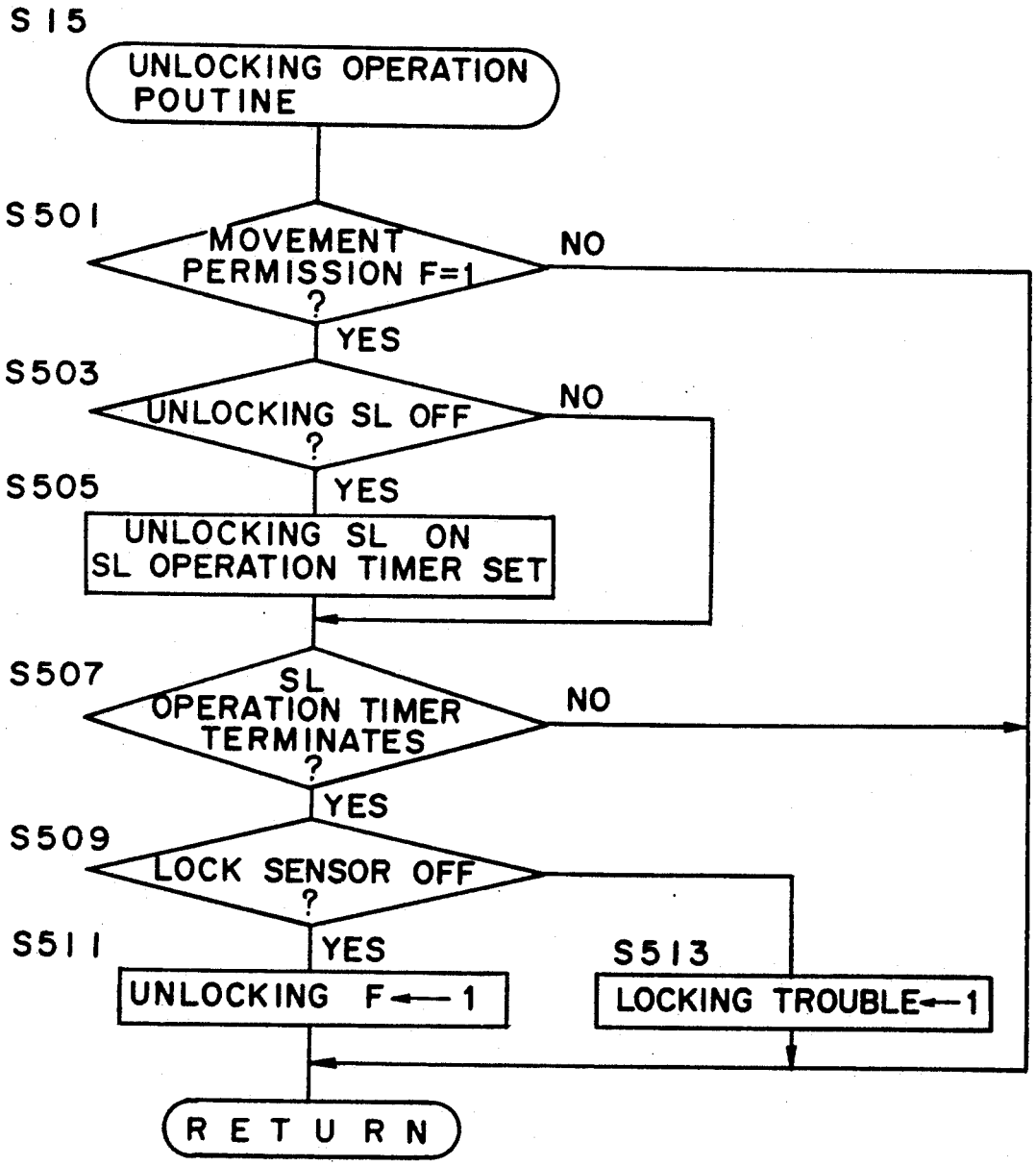
FIG. 19 is a flowchart showing the unlocking operation routine corresponding to Step 15 in FIG. 12.

5. Unlocking operation (FIG. 19)

In this subroutine, the developing unit 100 is unlocked when the movement permission flag is set to "1" in any one of the routines of the pre-movement routine (step 9), the movement permission deciding routine (step S13), and the post-movement routine (step S23) which will be described later.

If it is decided at step S501 that the movement permission flag is set to "1", the program goes to step S503 at which it is decided whether the unlocking solenoid 120 is in operation. If it is decided at step S503 that the solenoid 120 is not in operation, the unlocking solenoid 120 is turned on to start an unlocking operation and a solenoid operation timer is set at step S505. The unlocking solenoid 120 performs the unlocking operation in a sufficient period of time of 50 to 100 msec.

If it is decided at step S507 that the solenoid operation timer terminates counting up to a predetermined period of time, the program goes to step S509 at which it is decided whether or not the lock sensor 107 is OFF. If yes, i.e., if the developing unit 100 is unlocked, an unlocking flag is set to "1" at step S511.

If no at step S509, a lock trouble flag is set to "1" at step S513.

6. Setting of moving mode (FIG. 20)

The processing of this subroutine is executed at step S501 while the solenoid operation timer is performing its operation from the time when the movement permission flag is set to "1" until the time when the unlocking flag is set to "1" at step S511. In this subroutine, a signal for controlling the operation of the motor 61 is set.

As described previously, if the movement permission flag is set to "1" at step S601 and if the unlocking flag is reset to "0", the difference in value between "start position S" and "target position T", namely, data corresponding to the moving distance of the developing unit 100 is substituted into an internal variable "M" at step S605.

Then, according to a numerical value substituted into the internal variable "M", a signal indicating the rotational direction (CW/CCW) of the motor 61 and a signal indicating the rotational speed mode (M0, M1) thereof are set and a brake counter is initialized.

That is, if $M>0$, CW (upward direction of the developing unit 100) is set as the rotational direction of the motor 61. If $M<0$, CCW (downward direction) is set therefor.

The binary number of the absolute value of the internal variable "M" is set as the signal indicating the rotational speed mode (M0, M1) of the motor 61. The absolute value of the internal variable "M" is set as the initial value of the brake counter. The brake counter is used to control the brake timing in the developing unit moving routine which is described later.

The signal indicating the rotational direction of the motor 61, the signal indicating the rotational speed mode thereof, and the initial value of the brake counter are set as follows:

i) If it is decided at step S607 that $M=+3$, the program goes to step S609 at which CW (upward movement) is set, (M0, M1) is set to (1, 1), and the initial value of the brake counter is set to 3.

ii) If it is decided at step S611 that $M=+2$, the program goes to step S613 at which CW (upward movement) is set, (M0, M1) is set to (0, 1), and the initial value of the brake counter is set to 2.

iii) If it is decided at step S615 that $M=+1$, the program goes to step S617 at which CW (upward movement) is set, (M0, M1) is set to (1, 0), and the initial value of the brake counter is set to 1.

iv) If it is decided at step S619 that $M=-3$, the program goes to step S621 at which CCW (downward movement) is set, (M0, M1) is set to (1, 1), and the initial value of the brake counter is set to 3.

v) If it is decided at step S623 that $M=-2$, the program goes to step S625 at which CCW (downward movement) is set, (M0, M1) is set to (0, 1), and the initial value of the brake counter is set to 2.

vi) If it is decided at step S627 that $M=-1$, the program goes to step S629 at which CCW (downward movement) is set, (M0, M1) is set to (1, 0), and the initial value of the brake counter is set to 1.

Figure 21:
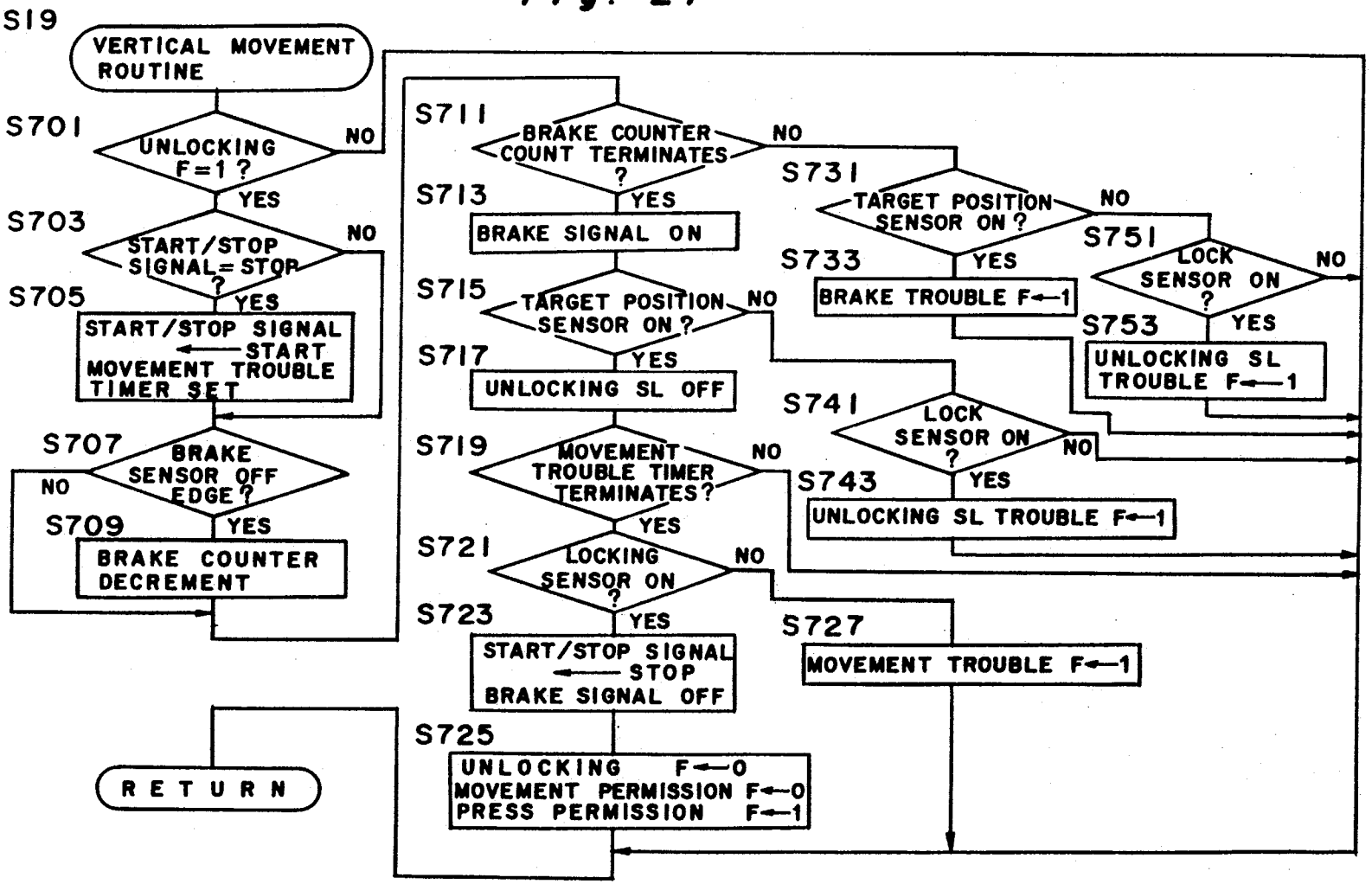
FIG. 21 is a flowchart showing the vertical movement routine corresponding to Step 19 in FIG. 12.

7. Movement of developing unit (FIG. 21)

In this subroutine, the start and stop of the motor 61 are controlled.

First, it is decided at step S701 whether or not the unlocking flag is set to "1". If yes, i.e., if the developing unit 100 is unlocked, the following processings are executed.

It is decided at step S703 whether or not "START/-STOP signal" is decided. If yes at step S703, i.e., if the movement of the developing unit 100 has not yet been started, the program goes to step S705 at which the "START/STOP signal" is set to "START" to start moving the developing unit 100 and a movement trouble timer for detecting the occurrence of a trouble during the movement of the developing unit 100 is set.

Then, it is decided at step S707 whether or not the brake sensor 105 for detecting the brake timing of the developing unit 100 is at OFF-edge. The brake sensor 105U operates during the upward movement of the developing unit 100. The brake sensor 105D operates during the downward movement of the developing unit 100. If yes, the value of the brake counter is decremented at step S709.

Then, the program goes to step S711 at which it is decided whether or not the brake counter terminates counting due to the decrement. If yes, the "brake signal" is set to ON at step S713 to brake the developing unit 100. If it is decided at step S731 that the sensor 103 is ON, the brake trouble flag is set to "1" at step S733. If it is decided at step S751 that the lock sensor 107 is ON, the unlocking flag solenoid trouble flag is set to "1" at step S753.

The program goes from step S713 to step S715 at which it is decided whether or not the target position sensor 103 (Bk, Y, M, C) is ON. If yes, the unlocking solenoid 120 is turned off to lock the developing unit 100. If it is decided at step S715 that the sensor 103 (Bk, Y, M, C) is not ON and if it is decided at step S741 that the lock sensor 107 is ON, the unlocking solenoid trouble flag is set to "1" at step S743.

After the processing is executed at step S717, the program goes to step S719 at which the CPU waits until the counting of the movement trouble timer set at step S715 terminates. When the counting terminates, it is decided at step S721 whether or not the lock sensor 107 is ON.

If yes at step S721, i.e., when the developing unit 100 is locked at a target position, the START/STOP signal is set to STOP and the brake signal is set to OFF at step S723. At step S725, the unlocking flag and the movement permission flag are reset to "0" and the pressing permission flag is set to "1" so that the developing device 101 at the developing position is pressed against the photosensitive drum 4 and a developing operation is carried out.

If it is decided at step S721 that the lock sensor 107 is OFF although the counting of the movement trouble timer terminates (step S719), that is, if the developing unit 100 is not locked, the movement trouble flag is set to "1" at step S727.

The routine for moving the motor 61 is executed in returning the developing unit 100 to the home position in the pre-movement routine (step S9) and the post-movement routine (step S23) which is described later. In this case, after the operation for moving the developing unit 100 terminates, the developing unit 100 is prohibited from being pressed against the photosensitive drum 4. Accordingly, after the developing unit 100 is returned to the home position, the pressing permission flag is reset to "0" (step S209) in the pre-movement routine.

Figure 22:
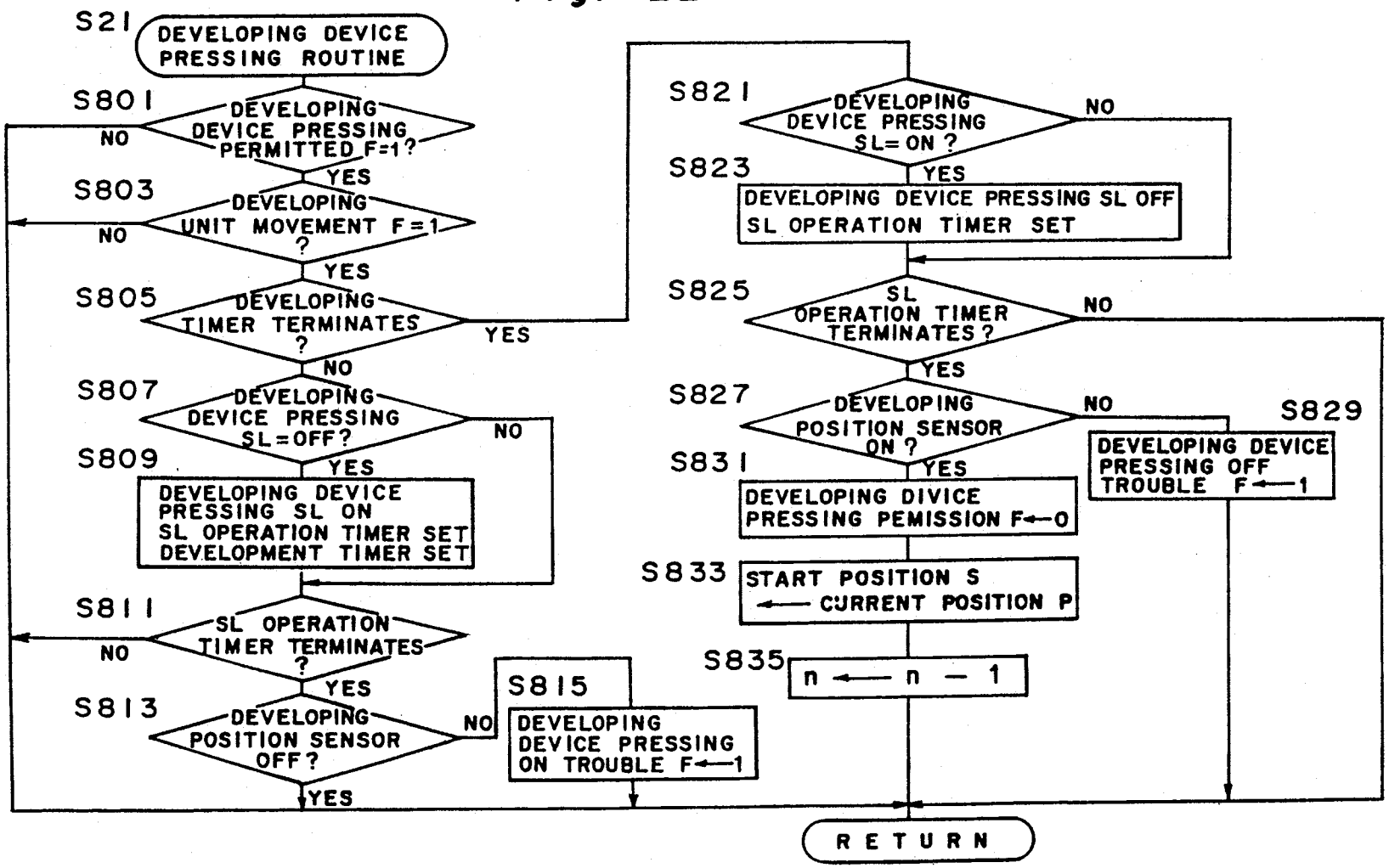
FIG. 22 is a flowchart showing the developing device pressing routine corresponding to Step 21 in FIG. 12.

8. Pressing of developing device against photosensitive drum (FIG. 22)

The developing device 101 is pressed against the photosensitive drum 4 and released therefrom in this subroutine.

If it is decided that the pressing permission flag and the developing unit moving flag are set to "1" at steps S801 and S803, respectively, the program goes to step S805 at which it is decided whether or not the counting of a development timer terminates. Sufficient period of time is allowed for the development timer to count time until a developing operation terminates.

i) Pressing

If no at step S805, the program goes to step S807 at which it is decided whether or not the operation for pressing the developing unit 100 against the photosensitive drum 4 starts. If it is decided at step S807 that the operation for pressing the developing device 101 against the photosensitive drum 4 is not started, the developing device pressing solenoid is turned on to start the pressing operation and in addition, the countings of the solenoid operation timer and the development timer are started.

When it is decided at step S811 that the solenoid operation timer terminates counting time, the program goes to step S813 at which it is decided whether or not the sensor 103 (Bk, Y, M, C) is OFF.

If yes, i.e., if the developing unit 100 is normally pressed against the photosensitive drum 4 (refer to FIG. 9A), the program returns to the main routine and at step S805, the termination of the counting of the development timer is waited.

If it is decided at step S813 that the sensor 103 remains ON, i.e., if the developing device 101 is not normally pressed against the photosensitive drum 4 (refer to FIG. 9B), a pressing ON trouble flag is set to "1" at step S815.

The developing device 101 is pressed against the photosensitive drum 4 by the above processing and then, a developing operation is performed by the control system not shown.

ii) Unlocking

If it is decided at step S805 that the development timer terminates counting time, the program goes to step S821 and steps subsequent thereto to release the developing device 101 from the photosensitive drum 4.

It is decided at step S821 whether or not the developing device pressing solenoid is ON. If yes, i.e., if the operation for releasing the developing device 101 from the photosensitive drum 4 is not started, the program goes to step S825 at which the developing device pressing solenoid is turned off to start the unlocking operation and the solenoid operation timer is set similarly to the operation for pressing the developing device 101 against the photosensitive drum 4.

If it is decided at step S825 that the operation of the solenoid operation timer terminates, it is decided at step S827 whether or not the sensor 103 (Bk, Y, M, C) is ON.

If yes at step S827, i.e., if the developing device 101 is normally pressed against the photosensitive drum 4, the program goes to step S831 at which the pressing permission flag is reset to "0". Then, at step S833, "current position P" (the number of the developing device 101 at the developing position) is set on "start position P". At step S835, the number of developing times (n) is decremented.

If it is decided at step S827 that the sensor 103 remains OFF although a sufficient period of time elapses in unlocking the developing device 101, a pressing OFF trouble flag is set to "1" at step S829 because the developing device 101 is not normally released from the photosensitive drum 4.

Figure 23:
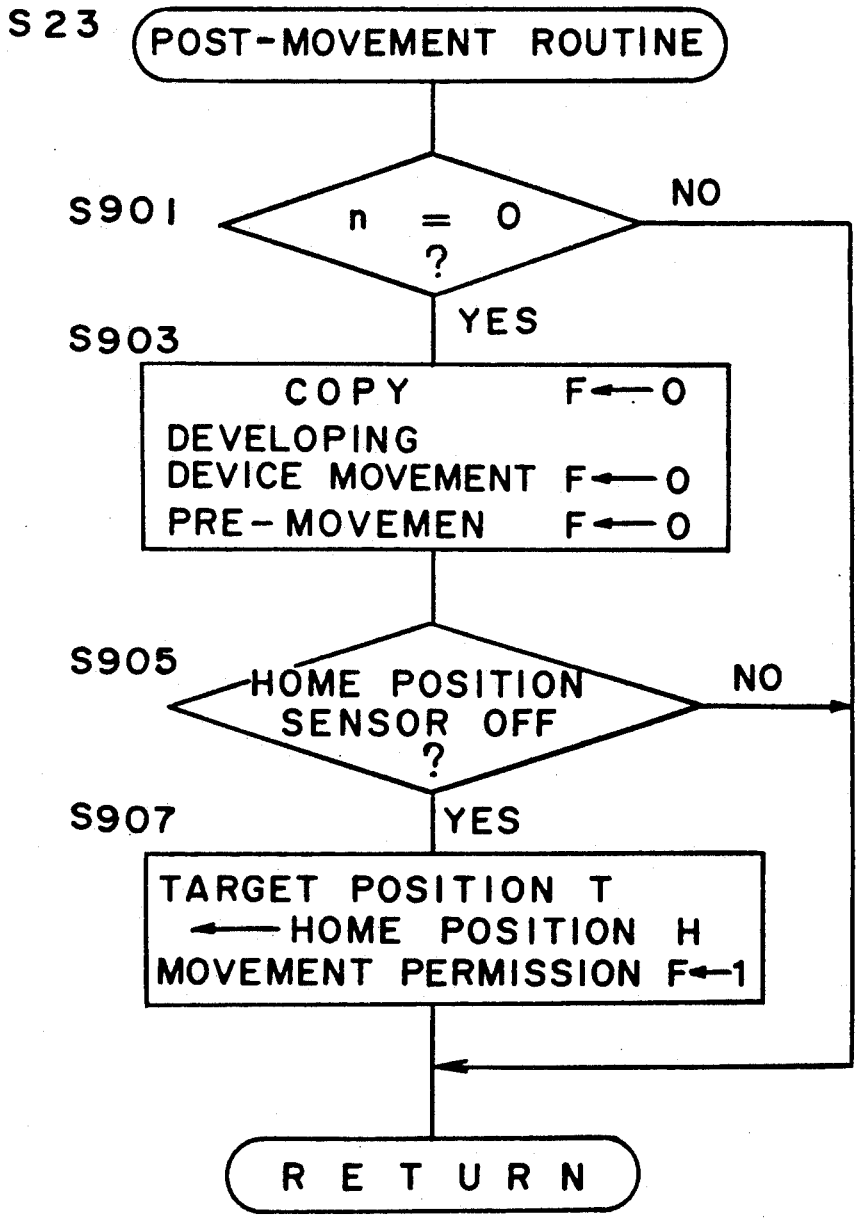
FIG. 23 is a flowchart showing the post-movement routine corresponding Step 23 in FIG. 12.

9. Post-movement (FIG. 23)

In this subroutine, after the developing operation terminates, each flag is initialized and the operation for returning the developing unit 100 to the home position starts.

If it is decided at step S901 that the value of the number of developing times (n) becomes "0", i.e., if the developing operation under the color mode set terminates, the program goes to step S903 at which the copy flag, the developing device movement flag, and the pre-movement flag are reset to "0".

Then, it is decided at step S905 whether or not the developing unit 100 is at the home position. If yes, at step S907, the home position is set as the target position and the movement permission flag is set to "1". Thus, the movement of the developing unit 100 to the home position is started.

Figure 24:
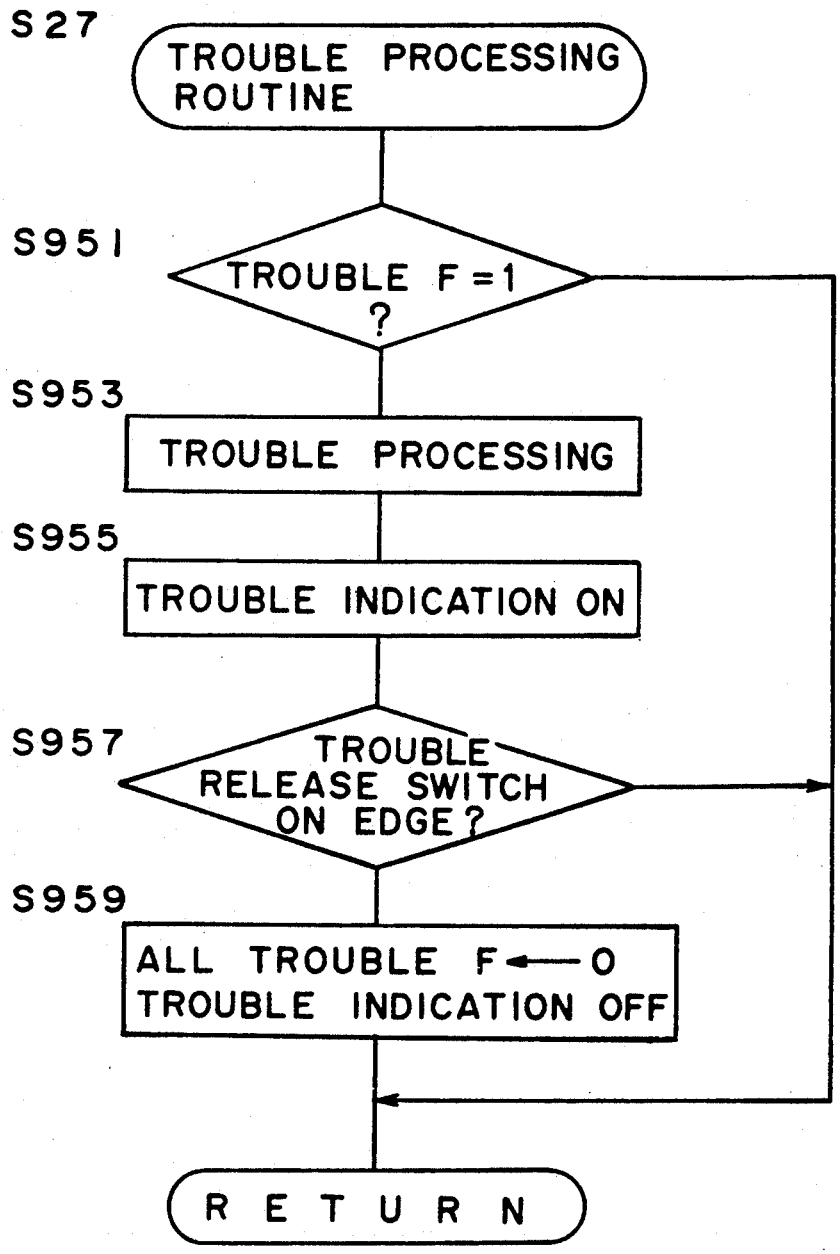
FIG. 24 is a flowchart showing the trouble processing routine corresponding to Step 27 in FIG. 12.

10. Processing for trouble (FIG. 24)

The processing of this subroutine is executed only when any one of the trouble flags is set to "1" (refer to FIG. 12).

If it is decided at step S951 that any one of the various trouble flags is set to "1", a processing corresponding to a trouble flag which has been set is executed at step S953 and the trouble indication making an indication of a trouble occurrence is turned on at step S955. According to these processings, user can cope with the trouble.

After a trouble remedying operation is carried out, the trouble release switch (FIG. 4) is pressed at step S957. As a result, all the trouble flags are reset to "0" and the trouble indication is turned off at step S959.

At step S953, the following processing is executed according to the type of trouble.

i) Trouble in pressing developing device against photosensitive drum

If it is decided that the sensor 103 is not turned off although a sufficient period of time has elapsed after the developing device pressing solenoid is turned on in pressing the developing device 101 against the photosensitive drum 4 (step S807 through step S815), it is decided that the operation for pressing the developing device 101 against the photosensitive drum 4 is not normally performed.

If this situation is not remedied, the electrostatic latent image formed on the photosensitive drum 4 is not developed into a toner image.

Therefore, the developing unit 100 is returned to the home position so as to prepare for subsequent copying operations and the copy paper is discharged from the apparatus. The copy paper is discharged to prevent a user from taking the time and trouble in carrying out a jam removing operation.

Instead of returning the developing unit 100 to the home position, the trouble can be remedied by prohibiting the movement of the developing unit 100.

ii) Trouble in unlocking developing device

If it is decided that the sensor 103 is not turned on in spite of the elapse of a sufficient period of time in unlocking the developing device 101 from the photosensitive drum 4 (step S821 through step S829) after the developing device pressing solenoid is turned off, it is decided that the operation for unlocking the developing device 101 from the photosensitive drum 4 is abnormal.

That is, the developing sleeve remains pressed against the photosensitive drum 4. If the developing unit 100 is moved in this situation, the photosensitive drum 4 and/or the developing sleeve may be damaged.

Accordingly, the movement of the developing unit 100 is prohibited and it is necessary to discharge the copy paper from the apparatus.

iii) Locking of developing unit before reaching target position

If the developing unit 100 is locked before it reaches the target position, the unlocking solenoid trouble flag is set to "1" at step S715, S741, S743 or S731, S751, S753.

Since the developing unit 100 is locked, the motor 61 is stopped.

Since it is impossible to obtain an image of a desired color, it is necessary to prohibit an image forming operation. Therefore, it is necessary to prohibit the developing device 101 from being pressed against the photosensitive drum 4 or the application of developing bias voltage is prohibited and discharge the copy paper from the apparatus.

iv) Trouble due to arrival of developing unit before applying brake

If the developing unit 100 reaches the target position before it is braked, the brake trouble flag is set to "1" (step S711 to S731, S733).

Since the developing unit 100 is moving at a high speed, it is necessary not to lock the developing unit 100 so that the apparatus is not damaged.

Accordingly, a counter electromotive force is applied to the motor 61 to brake it without locking the developing unit 100, namely, with the unlocking solenoid ON. Then, the developing unit 100 is locked and the copy paper is discharged from the apparatus.

The developing unit is applicable to developing systems other than the vertical moving system as described above, for example, horizontal moving system, rotary developing system in which the developing unit rotates in a predetermined direction, and system in which the developing unit pivots.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus having a plurality of developing devices, mounted on a movable supporting member, for performing a multi-color development comprising:

driving means for driving said movable supporting member in a predetermined direction;

developing device detecting means for detecting a developing device at a developing position in which a developing operation is performed;

developing device moving means for moving said developing device at the developing position between a first position, adjacent to an image holding member, in which a developing operation can be carried out and a second position a certain distance away from said image holding member; and control means for prohibiting the movement of said movable supporting member if said developing device is not detected by said developing device detecting means a predetermined period of time after said developing device moving means starts the operation for moving said developing device away from said first position toward said second position.

2. An image forming apparatus as claimed in claim 1, wherein said control means makes a further control for returning said movable supporting member to a predetermined reference position and discharging copy paper outside if said developing device is not detected by said developing device detecting means a predetermined period of time after said developing device moving means starts the operation for moving said developing device away from said first position toward said second position.

3. An image forming apparatus as claimed in claim 1, wherein said developing device detecting means comprises a developing position sensor provided in the developing position of a main body of said apparatus and an operating member, mounted on a casing of each developing device, for cooperating with said developing position sensor.

4. An image forming apparatus having a plurality of developing devices, mounted on a movable supporting member, for performing a multi-color development comprising:

driving means for driving said movable supporting member in a predetermined direction;

developing device at a developing position in which a developing operation is performed;

developing device moving means for moving said developing device at the developing position between a first position, adjacent to said image holding member, in which a developing operation can be carried out and a second position a certain distance away from said image holding member; and control means for moving said movable supporting member to a reference position of the movement of said movable supporting member if said developing device remains detected by said developing device detecting means a predetermined period of time after said developing device moving means starts the operation for moving said developing device from said second position toward same first position.

5. An image forming apparatus as claimed in claim 4, wherein said control means makes a further control for discharging copy paper outside of said developing device remains detected by said developing device detecting means a predetermined period of time after said developing device moving means starts the operation for moving said developing device from said second position toward said first position.

6. An image forming apparatus as claimed in claim 4, wherein said developing device detecting means comprises a developing position sensor provided in the developing position of a main body of said apparatus and an operating member, mounted on a casing of each developing device, for cooperating with said developing position sensor.

7. An image forming apparatus having a plurality of developing devices, mounted on a movable supporting member, for performing a multi-color development comprising:

driving means for driving said movable supporting member in a predetermined direction and stopping said movable supporting member so that a selected developing device is located at the developing position in which a developing operation is performed;

developing device moving means for moving said developing device at that developing position between a first position, adjacent to an image holding member, in which a developing operation can be carried out and a second position a predetermined distance away from said image holding member;

developing device detecting means for detecting the developing device at said developing position;

fixing means for fixing said movable supporting member at a predetermined position;

fixed state detecting means for detecting said movable supporting member when said movable supporting member is fixed to the predetermined position by said fixing means; and control means for operating said fixing means when the selected developing device is detected by said developing device detecting means and for subsequently operating said developing device moving means based on detection of the selected developing device by said developing device detecting means and detection of the fixed state by said fixed state detecting means.

8. An image forming apparatus as claimed in claim 7, wherein said fixing means comprises:

locking member receiving plate mounted on said movable supporting member and having cut-away portions corresponding to each developing device;

a locking member, disposed in a predetermined position, having a pivotal end and a locking end positioned opposite to said pivotal end;

driving means for pivoting said locking member between a locking position at which the locking end of said locking member is fixedly fitted into each cut-away portion of said locking member receiving plate and an unlocking position at which the locking end is unlocked from each cut-away portion of said locking member receiving plate.

9. An image forming apparatus as claimed in claim 7, wherein said developing device detecting means comprises a developing position sensor provided in the developing position of a main body of said apparatus and an operating member, mounted on a casing of each developing device, for cooperating with said developing position sensor.

10. An image forming apparatus having a plurality of developing devices, mounted on a movable supporting member, for performing a multi-color development comprising:

driving means for driving said movable supporting member in a predetermined direction and stopping said movable supporting member so that a selected developing device is located at a developing position in which a developing operation is performed;

developing device detecting means for detecting the developing device at said developing position;

fixing means for fixing said movable supporting member at a predetermined position;

control means for operating said fixing means when the selected developing device is detected by said developing device detecting means;

fixed state detecting means for detecting when said movable supporting member is fixed to the predetermined position by said fixing means; and control means for prohibiting the movement of said movable supporting member if said fixed state detecting means detects that said movable supporting member, which has started moving, is fixed to the predetermined position before the selected developing device is detected by said developing device detecting means.

11. An image forming apparatus as claimed in claim 10, wherein said control means further prohibits operation of the developing device if said fixed state detecting means detects that said movable supporting member, which has started moving, is fixed to the predetermined position before the selected developing device is detected by said developing device detecting means.

12. An image forming apparatus having a plurality of developing devices, mounted on a movable supporting member, for performing a multi-color development comprising:

driving means for driving said movable supporting member in a predetermined direction and stopping said movable supporting member so that a selected developing device is located at the developing position in which a developing operation is performed;

developing device detecting means for detecting the passage of developing devices through said developing position;

counting means for counting the number of developing devices which have passed said developing position based on a signal outputted from said developing device detecting means;

calculating means for calculating the number of developing devices which are to pass said developing position before the selected developing device reaches said developing position; and control means for outputting a stop signal to said driving means when the number of developing devices counted by said counting means coincides with the number calculated by said calculating means.

13. An image forming apparatus having a plurality of developing devices, mounted on a movable supporting member, for performing a multi-color development comprising:

driving means for driving said movable supporting member in a predetermined direction and stopping a selected developing device at a developing position in which a developing operation is performed;

drive control means for outputting a stop signal to said driving means at a predetermined timing so as to stop said movable supporting member so that a selected developing device is located at said developing position;

developing device detecting means for detecting the developing device at said developing position;

fixing means for fixing said movable supporting member when the selected developing device has reached said developing position; and control means for prohibiting an operation of said fixing means if the selected developing device at said developing position is detected before said stop signal is outputted.

14. An image forming apparatus as claimed in claim 13, wherein said control means makes a control for stopping the movement of said movable supporting member if the selected developing device at said developing position is detected before said stop signal is outputted.

15. An image forming apparatus having a plurality of developing devices mounted on a movable supporting member for performing a development by moving a desired developing device to a developing position, comprising:

driving means for driving said movable supporting member in a predetermined direction and stopping said movable supporting member so that a desired developing device is located at said developing position;

speed control means for controlling a driving speed of said driving means;

calculating means for calculating the number of developing devices which are to pass said developing position before the desired developing device reaches said developing position; and control means for outputting a speed change signal to said speed control means so as to change a speed of said movable supporting member according to a result obtained by said calculating means in such a manner that the speed of said movable supporting member is increased with the increase of the number of developing devices which are to pass said developing position;

wherein said driving means reciprocates said movable supporting member vertically or horizontally.

16. An image forming apparatus as claimed in claim 15, wherein said speed control means controls the driving direction of said driving means, and said control means outputs a driving direction alteration signal to said speed control means based on a position of said movable supporting member detected prior to the movement start of said movable supporting member and the target position thereof.

17. An image forming apparatus having a plurality of developing devices mounted on a movable supporting member for performing a multi-color development, comprising:

driving means for driving said movable supporting member in a predetermined direction and stopping said movable supporting member so that a selected developing device is located at a developing position in which a developing operation is performed;

developing device detecting means for detecting the developing device at said developing position;

fixing means for fixing said movable supporting member at a predetermined position;

control means for operating said fixing means when the selected developing device is detected by said developing device detecting means;

fixed state detecting means for detecting when said movable supporting member is fixed to the predetermined position by said fixing means; and control means for prohibiting the movement of said movable supporting member if said fixed state detecting means detects that said movable supporting member, which has started moving, is fixed to the predetermined position before the selected developing device is detected by said developing device detecting means;

said developing device being movable at the developing position between a first location adjacent to an image holding member and a second location away from the image holding member.

18. An image forming apparatus having a plurality of developing devices mounted on a movable supporting member for performing a multi-color development, comprising:

driving means for driving said movable supporting member in a predetermined direction and stopping a selected developing device at a developing position in which a developing operation is performed;

drive control means for outputting a stop signal to said driving means at a predetermined timing so as to stop said movable supporting member so that a selected developing device is located at said developing position;

developing device detecting means for detecting the developing device at said developing position;

fixing means for fixing said movable supporting member when the selected developing device has reached said developing position; and control means for prohibiting an operation of said fixing means if the selected developing device at said developing position is detected before said stop signal is outputted;

said developing device being movable at the developing position between a first location adjacent to an image holding member and a second location away from the image holding member.

* * * * *